United States Patent [19]

Yamanouchi et al.

[11] Patent Number: 5,075,197

[45] Date of Patent: Dec. 24, 1991

[54] DIFFUSION TRANSFER PHOTOGRAPHIC ELEMENTS

[75] Inventors: Junichi Yamanouchi; Yukio Karino, both of Kanagawa, Japan

[73] Assignee: Fuji Photo Film Co., Ltd., Kanagawa, Japan

[21] Appl. No.: 543,310

[22] Filed: Jun. 26, 1990

[30] Foreign Application Priority Data

Jun. 26, 1989 [JP] Japan ..... 1-163391

[51] Int. Cl.[5] ..... G03L 5/54

[52] U.S. Cl. ..... 430/213; 430/216; 430/941; 430/214

[58] Field of Search ..... 430/213, 216, 214, 551, 430/518, 941

[56] References Cited

U.S. PATENT DOCUMENTS

| | | | |
|---|---|---|---|
| 4,358,534 | 11/1982 | Sasaki et al. | 430/551 |
| 4,511,643 | 4/1985 | Toya | 430/551 |
| 4,547,452 | 10/1985 | Toya | 430/216 |
| 4,636,455 | 1/1987 | Aono et al. | 430/213 |
| 4,957,848 | 9/1990 | Takahashi et al. | 430/214 |

*Primary Examiner*—Richard L. Schilling

*Attorney, Agent, or Firm*—Sughrue, Mion, Zinn, Macpeak & Seas

[57] ABSTRACT

A diffusion transfer photographic element wherein there is included at least one layer which contains a water based polymer dispersion obtained by adding at least one ethylenic unsaturated monomer which contains a sulfinic acid group to a polymer dispersion which contains repeating units which have at least one quaternary ammonium salt and carrying out a polymerization.

3 Claims, No Drawings

DIFFUSION TRANSFER PHOTOGRAPHIC ELEMENTS

FIELD OF THE INVENTION

This invention relates to diffusion transfer photographic elements and, more precisely, novel polymer dispersions which are good mordants for dyes used in diffusion transfer photographic elements, and diffusion transfer photographic elements in which these polymer dispersions are used.

Still more precisely, the invention relates to mordants for fixing diffusible dyes which are produced in the form of an image, and peel-apart type color diffusion transfer photographic elements in which use is made of a layer which contains these novel mordants.

BACKGROUND OF THE INVENTION

Conventional color diffusion transfer photographic film units can be broadly classified into peel-apart type units and units which are used without being peeled-apart. The peel apart type units have a photo-sensitive layer and a dye image receiving layer established by coating each layer on separate supports and, after exposure in the form of an image, the photosensitive element and the dye image receiving element are laminated together with a processing composition spread between them, and subsequently the dye image which has been transferred to the dye image receiving layer is obtained by peeling-away the dye image receiving element.

The distinguishing feature of such an embodiment is that there is no loss of image quality of the sort seen with the type of unit which is not peeled-apart as described hereinafter, and extremely good color reproduction can be achieved because the dye image which has been formed on the image receiving layer which has been established by coating on a support is viewed directly. On the other hand, such a unit is inconvenient when operating a camera in that the photosensitive element and the image receiving element have to be laminated together in the camera. Furthermore, the elements are sticky from the alkaline processing fluid after peeling apart and they are liable to stick to the surroundings, and this is inconvenient when handling processed film.

Color diffusion transfer photographic film units of which the distinguishing features are that they are comprised of a photosensitive element which has established sequentially on a white support at least (a) a layer which has a neutralizing function, (b) a dye image receiving layer, (c) a peeling layer and (d) at least one silver halide emulsion layer which is combined with a dye image forming substance; an alkali processing composition which contains a light shielding agent; and a transparent cover sheet have been disclosed in JP-A-63-226649, and color diffusion transfer photographic film units comprised of a photosensitive element which has established sequentially on a white support at least (a) a dye image receiving layer (b) a peeling layer and (c) at least one silver halide emulsion layer which is combined with a dye image forming substance; an alkali processing composition which contains a light shielding agent; and a transparent cover sheet which has a layer which has at least a neutralizing function on the side on which the processing composition is spread have been disclosed is Japanese Patent Application No. 63-120201 (corresponding to JP-A-1-289950), and in each case a new peel-apart type photographic film unit has been suggested with a view to resolving the aforementioned problems. (The term "JP-A" as used herein signifies an "unexamined published Japanese patent application".) Moreover, peel-apart type color diffusion transfer photographic film units which have a dye image receiving layer and at least one silver halide emulsion layer which is combined with a dye image forming substance on the same support and which have a peeling layer between the dye image receiving layer and the silver halide emulsion layer have also disclosed in U.S. Pat. Nos. 4,529,683, 4,499,174, 4,401,746, 3,730,718 and 3,227,550.

When a non-diffusible dye releasing redox compound is used for the dye image forming substance and pyrazolidones are used as the developing agent in the preferred embodiments of these peel-apart type photographic film units, staining can occur after peeling apart. The peel surface pH immediately after peeling apart is preferably not more than 10, and most desirably not more than 8 but, of course, when there is no neutralizing layer, and even when a neutralizing layer is provided in the film unit, there are cases in which the peel surface pH immediately after peeling apart is not lowered enough. That is to say, there are, for example, cases in which the pH is not lowered adequately because the peeling apart has been carried out a little before the preferred peeling time, and cases in which the pH falls gradually after peeling apart but in which the pH has not fallen completely immediately after peeling apart. The developing agent on a peeled sheet surface which includes the dye image receiving layer which has been peeled apart in a condition such as this where the pH has not fallen is subjected to aerial oxidation and in some cases pink or yellow-brown staining is seen to occur, and this results in a marked loss of picture quality.

SUMMARY OF THE INVENTION

An object of the present invention is to provide color diffusion transfer photographic elements in which the occurrence of staining after peeling apart is suppressed.

Another object of the invention is to provide color diffusion transfer photographic elements which have a high picture quality with a high transfer density.

The inventors have discovered as a result of a thorough investigation that the objects of the invention can be realized by means of a diffusion transfer photographic element wherein there is included at least one layer which contains a water based polymer dispersion obtained by adding at least one ethylenic unsaturated monomer which contains a sulfinic acid group to a polymer dispersion which contains repeating units which have at least one quaternary ammonium salt and carrying out a polymerization.

DETAILED DESCRIPTION OF THE INVENTION

The water based polymer dispersion of the present invention is described in detail below.

First, the polymer dispersion which contains repeating units which have at least one quaternary ammonium salt in the present invention can be represented, for example, by the general formula (I) indicated below.

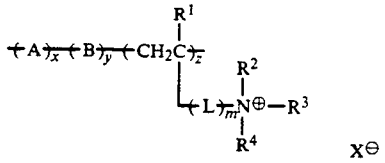

(I)

In this formula, A represents a monomer unit for which a copolymerizable monomer has been copolymerized in such a way that at least two copolymerizable ethylenic unsaturated groups are contained in the unit and at least one of these groups is contained in a side chain. B represents a monomer unit for which a copolymerizable ethylenic unsaturated monomer has been copolymerized. $R^1$ represents a hydrogen atom, a lower alkyl group or an aralkyl group. L represents a divalent linking group which has from 1 to 20 carbon atoms. $R^2$, $R^3$ and $R^4$ which may be the same or different, each represents an unsubstituted alkyl group or a substituted alkyl group which has from 1 to 20 carbon atoms or an unsubstituted aryl group or a substituted aryl group which has from 6 to 20 carbon atoms. Any two of the groups represented by $R^2$, $R^3$, $R^4$ and L may be joined together to form, together with the nitrogen atom, a ring structure.

$X^{\ominus}$ represents an anion, and m represents 0 or 1.

Moreover, x, y and z represent the mol percentages of each component, and x has a value from 0 to 60, y has a value from 0 to 95, and z has a value from 5 to 100.

More precisely, the monomer for A in general formula (I) is, for example, divinylbenzene, ethyleneglycol dimethacrylate, diethyleneglycol dimethacrylate, triethyleneglycol dimethacrylate, ethyleneglycol diacrylate, diethyleneglycol diacrylate, 1,6-hexanediol diacrylate, neopentylglycol dimethacrylate or tetramethylene dimethacrylate, and from among these compounds divinylbenzene and ethyleneglycol dimethacrylate are especially desirable.

Examples of the ethylenic unsaturated monomer for B include ethylene, propylene, 1-butene, iso-butene, styrene, α-methylstyrene, vinyl ketone, mono-ethylenic unsaturated esters of fatty acids (for example, vinyl acetate, allyl acetate), esters or amides of ethylenic unsaturated mono- or di-carboxylic acids (for example, methyl methacrylate, ethyl methacrylate, n-butyl methacrylate, n-hexyl methacrylate, cyclohexyl methacrylate, benzyl methacrylate, n-butyl acrylate, n-hexyl acrylate, 2-ethylhexyl acrylate, acrylamide, N-methylacrylamide), mono-ethylenic unsaturated compounds (for example, acrylonitrile) and dienes (for example, butadiene, isoprene), and from among these styrene, n-butyl methacrylate and methyl methacrylate, for example, are especially desirable. The monomer unit represented by B may include two or more of the above mentioned monomers.

Furthermore, monomers which have within the molecule groups which react with tertiary amines in such a way as to form quaternary ammonium salts (for example, vinylbenzyl chloride) and hydrolyzates thereof (for example, hydroxymethylstyrene) are also included among the monomers which can be used for B. These may be unreacted monomers or by-products when carrying out a polymerization reaction with a tertiary amine.

$R^1$ is preferably a hydrogen atom or a lower alkyl group which has from 1 to 6 carbon atoms (for example, methyl, ethyl, n-propyl, n-butyl, n-amyl, n-hexyl) or an aralkyl group (for example, benzyl), and of these the hydrogen atom and the methyl group are especially desirable.

L represents a divalent linking group which has from 1 to 20 carbon atoms, and in practical terms it can be represented by $-(X^1)_p(J^1-X^2)_q(J^2-X^3)_r(J^3-X^4)_s(J^4)_t$. Here, $X^1$, $X^2$, $X^3$ and $X^4$, which may be the same or different, each represents, for example, —COO—, —OCO—,

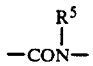

(where $R^5$ represents a hydrogen atom, an unsubstituted alkyl group which has from 1 to 6 carbon atoms (for example, methyl, ethyl) or a substituted alkyl group which has from 1 to 6 carbon atoms (for example, methoxyethyl)), —CO—, $-SO_2-$,

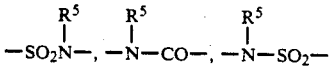

(where $R^5$ has the same significance as described above),

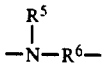

(where $R^5$ has the same significance as before and $R^6$ represents an alkylene group which has from 1 to about 4 carbon atoms (for example, methylene, dimethylene)),

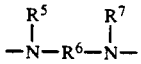

(where $R^5$ and $R^6$ have the same significance as before and $R^7$ represents a hydrogen atom, an unsubstituted alkyl group which has from 1 to 6 carbon atoms (for example, methyl, ethyl) or a substituted alkyl group which has from 1 to 6 carbon atoms (for example, methoxyethyl)), —O—, —S—,

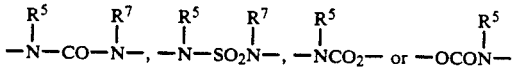

(where $R^5$ and $R^7$ have the same significance as before).

$J^1$, $J^2$, $J^3$ and $J^4$ which may be the same or different, each represents an unsubstituted alkylene group, a substituted alkylene group, an arylene group, a substituted arylene group, an unsubstituted aralkylene group or a substituted aralkylene group.

Moreover, p, q, r, s and t represent 0 or 1, but they cannot all be 0 at the same time.

Examples of substituent groups for the above mentioned L groups include a halogen atom, a nitro group, a cyano group, an unsubstituted alkyl group (for example, methyl, ethyl, butyl), a substituted alkyl group (for example, methoxyethyl, benzyl), an unsubstituted alkoxy group, a substituted alkoxy group, a group which can be represented by $-NHCOR^8$ (where $R^8$ represents an unsubstituted alkyl group, a substituted alkyl group, an unsubstituted phenyl group, a substituted phenyl group, an unsubstituted aralkyl group or a substituted aralkyl group) (for example, acetamido, benzamido), $—NHSO_2R^8$ (where $R^8$ has the same significance as before) (for example, methylsulfonamido, p-tolylsulfonamido), $—SOR^8$ (where $R^8$ has the same significance as before) (for example, methylsulfinyl), $—SO_2R^8$ (where $R^8$ has the same significance as before) (for example, phenylsulfonyl, methylsulfonyl), $—COR^8$ (where $R^8$ has the same significance as before) (for example, methylcarbonyl, butylcarbonyl, phenylcarbonyl), a group which can be represented by

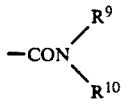

(where $R^9$ and $R^{10}$ which may be the same or different, each represents a hydrogen atom, an unsubstituted alkyl group, a substituted alkyl group, an unsubstituted phenyl group, a substituted phenyl group, an unsubstituted aralkyl group or a substituted aralkyl group) (for example, methylcarbamoyl, dimethylcarbamoyl, phenylcarbamoyl),

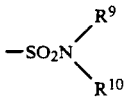

(where $R^9$ and $R^{10}$ have the same significance as before) (for example, methylsulfamoyl, phenylsulfamoyl), an amino group (which may be substituted with an alkyl group) (for example, amino, isopropylamino), a hydroxyl group and a group which form a hydroxyl group on hydrolysis (for example, acetoxy).

The most desirable linking groups represented by L include an alkylene group (for example, methylene, ethylene, trimethylene, hexamethylene), a phenylene group (for example, o-phenylene, p-phenylene, m-phenylene), an arylenealkylene group (for example,

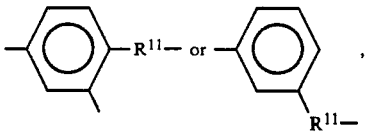

where $R^{11}$ represents an alkylene group which has from 1 to about 12 carbon atoms) (for example,

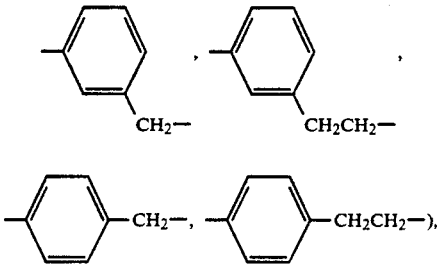

$—CO_2—$, $—CO_2—R^{12}—$ (where $R^{12}$ represents an alkylene group, a phenylene group or an arylenealkylene group) (for example, $—COOCH_2CH_2—$,

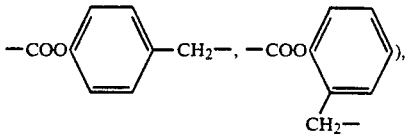

$—CONH—R^{12}—$ (where $R^{12}$ has the same significance as before) (for example, $—CONHCH_2CH_2—$, $—CONHCH_2CH_2CH_2—$,

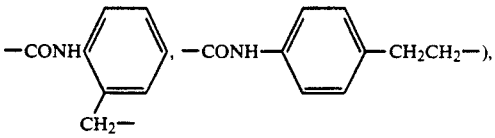

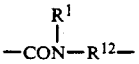

(where $R^1$ and $R^{12}$ have the same significance as before) (for example, $—CONHCH_2CH_2—$, $—CONHCH_2CH_2CH_2—$,

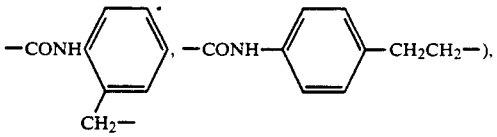

and the following groups are especially desirable for the linking groups L:

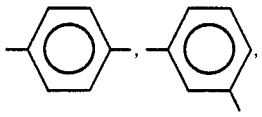

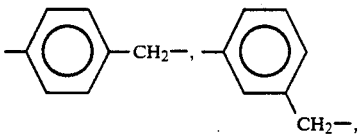

$—CO_2—$, $—CONH—$, $—CO_2—CH_2CH_2—$, $—CO_2—CH_2CH_2CH_2—$, $—CONHCH_2—$, $—CONHCH_2CH_2—$, $—CONHCH_2CH_2CH_2—$ $R^2$, $R^3$ and $R^4$ are preferably alkyl groups which have from 1 to 20 carbon atoms, aryl groups which have from 6 to 20 carbon atoms or aralkyl groups which have from 7 to 20 carbon atoms, and they may be the same or different. These alkyl groups, aryl groups and aralkyl groups include substituted alkyl groups, substituted aryl groups and substituted aralkyl groups.

The alkyl groups may be unsubstituted alkyl groups (for example, methyl, ethyl, n-propyl, isopropyl, n-butyl, isobutyl, t-butyl, n-amyl, isoamyl, n-hexyl, cyclohexyl, n-heptyl, n-octyl, 2-ethylhexyl, n-nonyl, n-decyl, n-dodecyl) and they preferably have from 1 to 12 carbon atoms. Most desirably, the alkyl groups have from 1 to 10 carbon atoms. Examples of substituted alkyl groups include alkoxyalkyl groups (for example, methoxymethyl, methoxyethyl, methoxybutyl, ethoxyethyl, ethoxypropyl, methoxybutyl, butoxyethyl, butoxypropyl, butoxybutyl, vinyloxyethyl), cyanoalkyl groups (for example, 2-cyanoethyl, 3-cyanopropyl, 4-cyanobutyl), halogenated alkyl groups (for example, 2-fluoroethyl, 2-chloroethyl, 3-fluoropropyl), alkoxycarbonylalkyl groups (for example, ethoxycarbonylmethyl), allyl groups, 2-butenyl groups and propargyl groups.

The aryl groups may be unsubstituted aryl groups (for example, phenyl, naphthyl), or substituted aryl groups, such as alkylaryl groups (for example, 2-methylphenyl, 3-methylphenyl, 4-methylphenyl, 4-ethylphenyl, 4-isopropylphenyl, 4-tert-butylphenyl), alkoxyaryl groups (for example, 4-methoxyphenyl, 3-methoxyphenyl, 4-ethoxyphenyl) or aryloxyaryl groups (for example, 4-phenoxyphenyl). The aryl groups preferably have from 6 to 14, and most desirably from 6 to 10, carbon atoms. The phenyl group is especially desirable.

Examples of aralkyl groups include unsubstituted aralkyl groups (for example, benzyl, phenethyl, diphenylmethyl, naphthylmethyl) and substituted aralkyl groups, for example, alkylaralkyl groups (for example, 4-methylbenzyl, 2,5-dimethylbenzyl, 4-isopropylbenzyl), alkoxyaralkyl groups (for example, 4-methoxybenzyl, 4-ethoxybenzyl), cyanoaralkyl groups (for example, 4-cyanobenzyl), perfluoroalkoxyaralkyl groups (for example, 4-pentafluoropropoxybenzyl, 4-undecafluorohexyloxybenzyl) and halogenated aralkyl groups (for example, 4-chlorobenzyl, 4-bromobenzyl, 3-chlorobenzyl). The aralkyl groups preferably have from 7 to 15, and most desirably from 7 to 11, carbon atoms. From among these groups, the benzyl group and the phenethyl group are especially desirable.

$X^{\ominus}$ represents an anion, for example, a halogen ion (for example, chloride ion, bromide ion), an alkyl or aryl sulfonate ion (for example, methanesulfonate, ethanesulfonate, benzenesulfonate, p-toluenesulfonate), an acetate ion, a sulfate ion or a nitrate ion, and it is most desirably a chloride ion, an acetate ion or a sulfate ion.

Furthermore, any two of L, $R^2$, $R^3$ and $R^4$ may be joined together, and the formation of a ring structure, together with the nitrogen atom, is desirable. The ring structure which is formed is preferably a pyrrolidine ring, a piperidine ring, a morpholine ring, a pyridine ring, an imidazole ring or a quinuclidine ring. Most desirably, the ring which is formed is a pyrrolidine ring, a morpholine ring, a piperidine ring, an imidazole ring or a pyridine ring.

Moreover, m represents 0 or 1, and is preferably 1.

Furthermore, x is from 0 to 60 mol % preferably from 0 to 40 mol %, and most desirably from 0 to 30 mol %.

Furthermore, y is from 0 to 95 mol %, preferably from 0 to 60 mol %, and most desirably from 0 to 40 mol %.

Furthermore, z is from 5 to 100 mol %, preferably from 10 to 100 mol %, and most desirably from 40 to 100 mol %.

The ethylenic unsaturated monomers which contain sulfinic acid groups which are used in this present invention are described in detail below.

The ethylenic unsaturated monomers which contain sulfinic acid groups of this present invention can be represented by the general formula (II) indicated below.

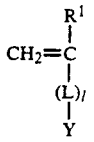

(II)

In general formula (II), $R^1$ and L represent groups selected from among the same groups described in connection with general formula (I).

Moreover, l represents 0 or 1.

$R^1$ is preferably a hydrogen atom or a methyl group.

L represents a divalent linking group which has from 1 to 20 carbon atoms, and the following groups are examples of groups which are especially desirable for L:

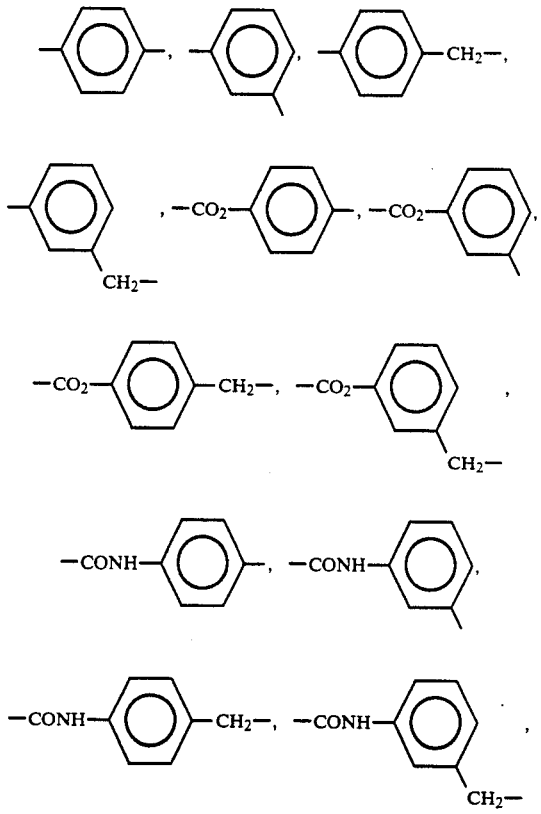

$-CO_2CH_2CH{=}CHCH_2-$, $-CONHCH_2CH{=}CHCH_2-$.

Furthermore, Y represents a sulfinic acid group or a sulfinic acid group which has formed a salt. The cations which form the sulfinic acid salts are preferably of valency from 1 to 3, and when the valency of the cation is 2 or more there may be other counter anions in addition to the monomers represented by general formula (II). The ammonium ion and metal ions are preferred as cations, and alkali metal ions (for example, sodium ion, potassium ion) are especially desirable.

Actual examples of preferred monomers which can be represented by the general formula (II) are indicated below.

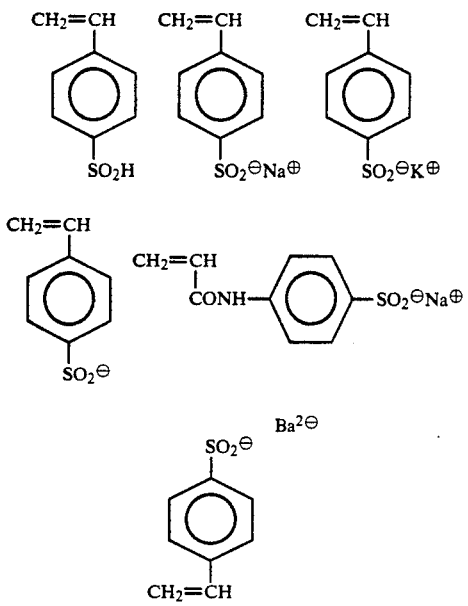

In the present invention, two or more of the ethylenic unsaturated monomers which have one sulfinic acid group which are added to the polymer dispersion can be used conjointly.

Furthermore, ethylenic unsaturated monomers which do not have sulfinic acid groups can also be used conjointly at this time. Compounds selected from among the same group of ethylenic unsaturated monomers for B, as described earlier, can be used as the ethylenic unsaturated monomers which may be used conjointly.

In the present invention, the amount of the ethylenic unsaturated monomer which contains a sulfinic acid group which is added can be varied according to the amount of quaternary ammonium salt in the polymer dispersion, but it is preferably from 0.1 to 70 mol %, and most desirably from 1 to 50 mol % with respect to the amount of quaternary ammonium salt in the polymer dispersion.

Furthermore, the ethylenic unsaturated monomers which have no sulfinic acid group which can be used conjointly can be added in any amount, as required, but they are preferably added in amounts of from 0 to 200 mol %, and most desirably in amounts of from 0 to 100 mol %, with respect to the monomer which does have sulfinic acid groups.

Actual examples of polymers (a) which have quaternary ammonium salts for the polymer dispersions which are used in this present invention, and polymers (b) which are obtained by polymerizing at least one ethylenic unsaturated monomer which has a sulfinic acid group are shown below, but the invention is not limited by these examples. (The proportions of (a) and (b) represent the mol percentages of the quaternary ammonium salt and the sulfinic acid group in the monomer which has the sulfinic acid groups).

Illustrative Compound (1)

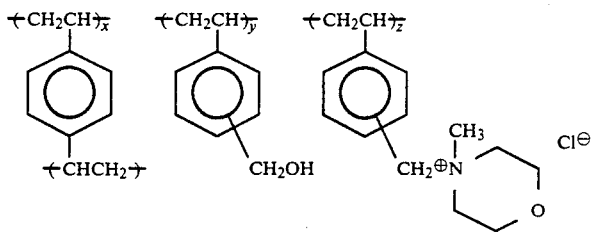

(1-a)

x:y:z = 5:20:75 (mol radio)

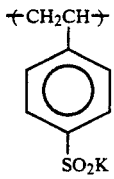

(1-b)

(a):(b) = 90.9:9.1

Illustrative Compound (2)

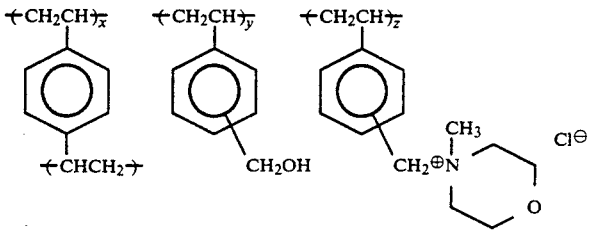

(2-a)

x:y:z = 5:20:75 (mol radio)

-continued
(2-b)
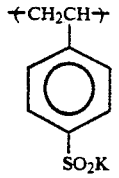
(a):(b) = 83.3:16.7
Illustrative Compound (3)
(3-a)
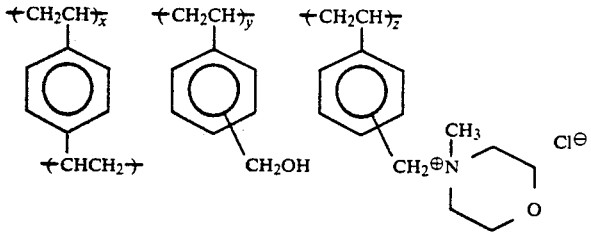
x:y:z = 5:20:75 (mol radio)
(3-b)
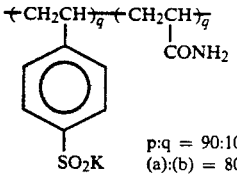
p:q = 90:10(mol ratio)
(a):(b) = 80:20
Illustrative Compound (4)
(4-a)
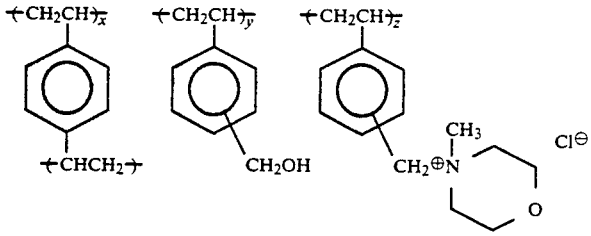
x:y:z = 5:20:75 (mol radio)
(4-b)
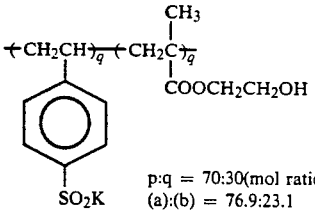
p:q = 70:30(mol ratio)
(a):(b) = 76.9:23.1
Illustrative Compound (5)
(5-a)
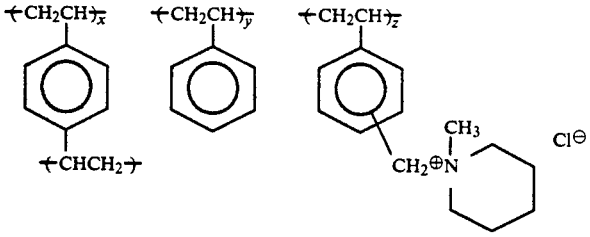
x:y:z = 5:47.5:47.5 (mol radio)
(5-b)
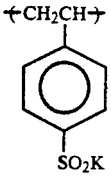
(a):(b) = 90.9:9.1

-continued
Illustrative Compound (6)
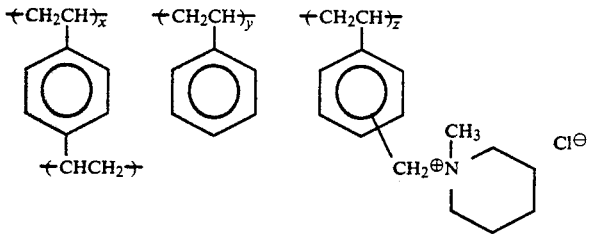
(6-a)
x:y:z = 5:47.5:47.5 (mol radio)
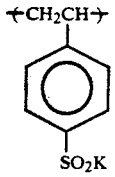
(6-b)
(a):(b) = 76.9:23.1
Illustrative Compound (7)
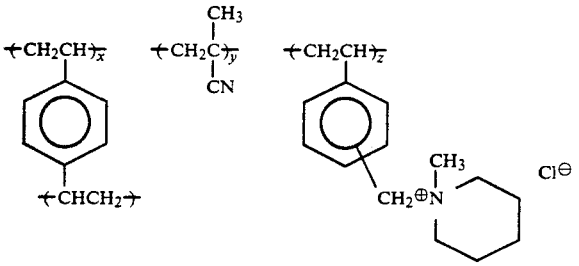
(7-a)
x:y:z = 10:30:60 (mol radio)
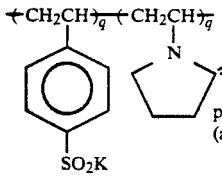
(7-b)
p:q = 80:20(mol ratio)
(a):(b) = 70:30
Illustrative Compound (8)
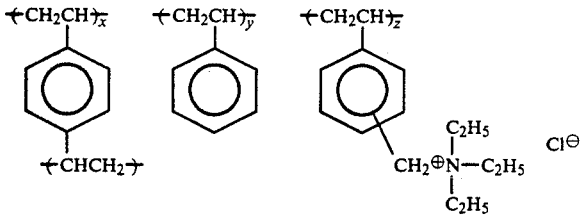
(8-a)
x:y:z = 5:47.5:47.5 (mol radio)
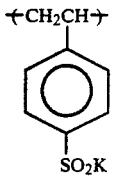
(8-b)
(a):(b) = 83.3:16.7
Illustrative Compound (9)

-continued
(9-a)
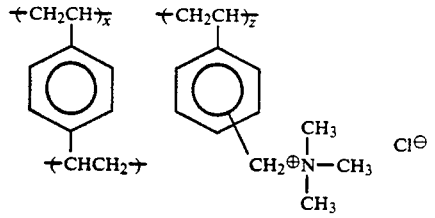
x:y:z = 20:80 (mol radio)
(9-b)
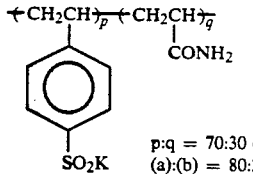
p:q = 70:30 (mol ratio)
(a):(b) = 80:20
Illustrative Compound (10)
(10-a)
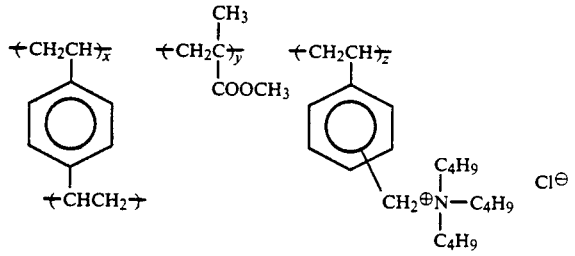
x:y:z = 10:45:45 (mol radio)
(10-b)
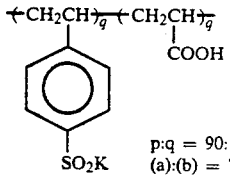
p:q = 90:10
(a):(b) = 75:25
Illustrative Compound (11)
(11-a)
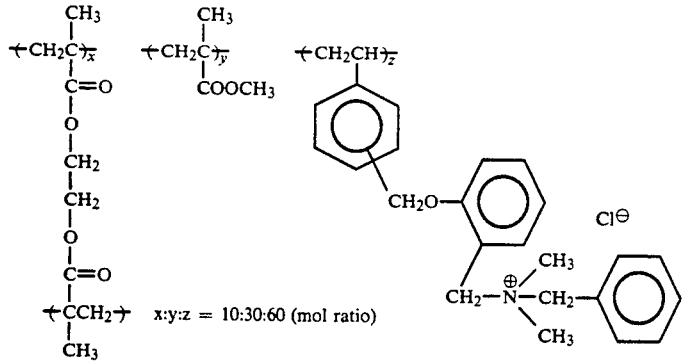
x:y:z = 10:30:60 (mol ratio)
(11-b)
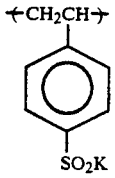
(a):(b) = 80:20
Illustrative Compound (12)

-continued (12-a)

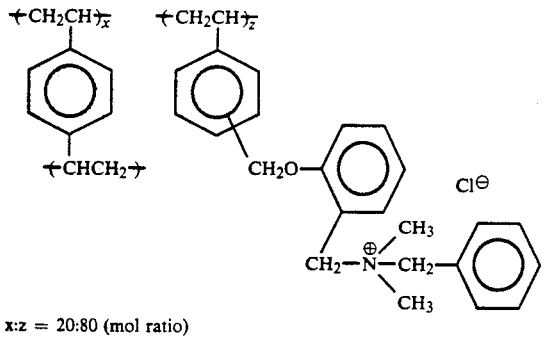

x:z = 20:80 (mol ratio)

(12-b)

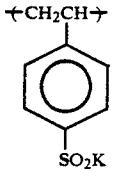

(a):(b) = 90:10

Methods for the preparation of polymer dispersions in accordance with this present invention are described in detail below.

First, polymer dispersions which have at least one quaternary ammonium group which can be represented by general formula (I) can be prepared using known methods such as that disclosed, for example, in JP-A-59-219745.

Polymers for the polymer dispersions represented by general formula (I) of the present invention can be obtained in general by the emulsion polymerization of a copolymerizable monomer which has at least two ethylenic unsaturated groups as mentioned above, an ethylenic unsaturated monomer and an unsaturated monomer which can be represented by the general formula:

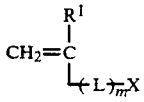

(where $R^1$, L, m and X have the same significance as described earlier) (for example, chloromethylstyrene, N-(2-chloroethyl)methacrylamide), followed by quaternization with a tertiary amine which has the structure

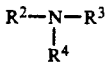

(where $R^2$, $R^3$, and $R^4$ have the same significance as described earlier) (for example, trimethylamine, triethylamine, tri-n-butylamine, N,N-dimethylbenzylamine, N-methylpiperidine, N-methylmorpholine, pyridine or 4-methylpyridine).

Furthermore, polymers for the polymer dispersions represented by general formula (I) of the present invention can be obtained by polymerizing a copolymerizable monomer which has a least two ethylenic unsaturated groups as mentioned above, an ethylenic unsaturated monomer and an unsaturated monomer which can be represented by the following general formula:

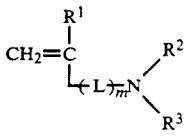

(where $R^1$, $R^2$, $R^3$, L and m have the same significance as before) (for example, N,N-dimethylaminoethyl methacrylate, N,N,-diethylaminoethyl methacrylate, N,N-dimethylaminoethyl acrylate, N,N-diethylaminoethyl acrylate, N-(N,N-dimethylaminopropyl)acrylamide, N-(N,N-dihexylaminomethyl)acrylamide, 3-(4-pyridyl)propyl acrylate, N-ethylaminomethylstyrene, N,N-dimethylaminomethylstyrene, N,N-diethylaminomethylstyrene, N,N-dipropylaminomethylstyrene, N-vinylbenzylmorpholine, N-vinylbenzylpiperidine, 2-vinylpyridine or 4-vinyl pyridine or N-vinylimidazole), followed by quaternization with a compound which has the structure $R^4$—X (where $R^4$ and X have the same significance as before) (for example, methyl p-toluenesulfonate, dimethyl sulfate, diethyl sulfate, ethyl bromide, n-propyl bromide, allyl chloride, n-butyl bromide, chloro-2-butene, ethyl chloroacetate, n-hexyl bromide, n-octyl bromide; aralkylating agents, such as benzyl chloride, benzyl bromide, p-nitrobenzyl chloride, p-chlorobenzyl chloride, p-methylbenzyl chloride, p-isopropylbenzyl chloride, dimethylbenzyl chloride, p-methoxybenzyl chloride, p-pentafluoropropenyloxybenzyl chloride, naphthyl chloride, or diphenylmethyl chloride, and preferably methyl p-toluenesulfonate, dimethyl sulfate, diethyl sulfate or benzyl chloride).

Furthermore, polymers for the polymer dispersions which can be represented by general formula (I) of the present invention can be prepared using the method disclosed in JP-A-62-34159 or methods based on the method disclosed in JP-A-61-296352.

In this case, the polymers for the polymer dispersions represented by general formula (I) can be prepared by polymerizing a copolymerizable monomer which has at least two ethylenic unsaturated groups as described above, an ethylenic unsaturated monomer and an unsaturated monomer which can be represented by the following general formula:

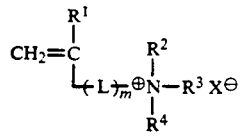

(where $R^1$, $R^2$, $R^3$, $R^4$, X, L and m have the same significance as before) (for example, N-vinylbenzyl-N,N,N-trimethylammonium chloride, N-vinylbenzyl-N,N,N-triethylammonium chloride, N-vinylbenzyl-N,N,N-tributylammonium chloride, N-vinylbenzyl-N,N,N-trihexylammonium chloride, N-vinylbenzyl-N-dodecylpiperidinium chloride, N-vinylbenzyl-N-methylmorpholinium chloride, N'-vinylbenzyl-N-benzylimidazolium chloride, 4-vinyl-N-hexylpyridinium bromide, N-(2-acryloyloxyethyl)-N,N,N-triethylammonium chloride, N-(3-acrylamidopropyl)-N,N,N-triethylammonium chloride or N-(3-acrylamidopropyl)-N,N,N-tributylammonium bromide).

In general, the polymerization reactions described above can be carried out using known methods of emulsion polymerization.

The emulsion polymerization can be carried out by emulsifying the monomers in water or in a mixed solvent containing organic solvent which is miscible with water (for example, methanol, ethanol or acetone) using at least one emulsifying agent and then carrying out the polymerization using a radical polymerization initiator, generally at a temperature of from 30° C. to about 100° C. and preferably at a temperature of from 40° C. to about 90° C. The amount of water-miscible organic solvent used is from 0 to 100%, and preferably from 0 to 50%, by volume with respect to the water.

The polymerization reaction is usually carried out using from 0.1 to 10 wt % of an emulsifying agent, as required, and from 0.05 to 5 wt % of a radical polymerization initiator with respect to the monomer which is to be polymerized. Azobis compounds, peroxides, hydroperoxides and redox catalysts, for example, can be used for the polymerization initiator, and actual examples of such compounds include potassium persulfate, ammonium persulfate, tert-butyl peroctanoate, benzoyl peroxide, isopropyl percarbonate, 2,4-dichlorobenzoyl peroxide, methyl ethyl ketone peroxide, cumene hydroperoxide, dicumyl peroxide, azobisisobutyronitrile and 2,2'-azobis(2-amidinopropane) hydroperoxide.

Anionic, cationic, amphoteric and nonionic surfactants, and water soluble polymers, for example, can be used as emulsifying agents. For example, use can be made of sodium laurate, sodium dodecylsulfonate, sodium 1-octoxycarbonylmethyl-1-octoxycarbonylmethanesulfonate, sodium laurylnaphthalenesulfonate, sodium laurylbenzenesulfonate, sodium laurylphosphate, cetyltrimethylammonium chloride, dodecyltrimethylammonium chloride, N-2-ethylhexylpyridinium chloride, polyoxyethylene nonylphenyl ether, polyoxyethylenesorbitan lauryl ester, poly(vinyl alcohol), and the emulsifying agents and water soluble polymers disclosed in JP-B-53-190 can also be used as emulsifying agents. (The term "JP-B" as used herein signifies an "examined Japanese Patent publication".)

The polymerization initiator, the concentration, the polymerization temperature and the reaction time, for example, can be varied over a wide range in the emulsion polymerization, and the system can be modified easily.

The above mentioned reactions in which quaternary ammonium salts are formed are generally carried out at a temperature of from about 5° C. to about 90° C., and most desirably at a temperature of 20° C. to about 80° C.

The polymerization of the ethylenic unsaturated monomer which contains a monomer which contains a sulfinic acid group in the present invention is described below.

First, an ethylenic unsaturated monomer which contains at least one ethylenic unsaturated monomer which has a sulfinic acid group is added to the aforementioned polymer dispersion which has quaternary ammonium groups. The whole amount of the monomer may be added at once, or the addition can be made in a dropwise manner over a period ranging from a few minutes to about 1 hour. No particular limitation is imposed upon the temperature at the time at which the monomer is added, but it is preferably from 5° C. to 80° C. Furthermore, the polymer dispersion is preferably agitated during the addition. The addition of the ethylenic unsaturated monomer may consist of the addition of the monomer alone, or the monomer may be diluted by, or dissolved in, an auxiliary solvent (for example, water or an organic solvent, such as, methanol, ethanol, propanol, acetone, ethyl acetate, acetonitrile, or a mixture of these solvents), as required.

The polymerization of the ethylenic unsaturated monomer which has been added subsequently can be carried out using the normal methods for a solution polymerization reaction.

The polymerization reaction is normally carried out at a temperature of from about 30° C. to 100° C., and preferably at a temperature of from about 40° C. to about 90° C.

Furthermore, the polymerization reaction can be carried out using from 0.05 to 5 wt % with respect to the ethylenic unsaturated monomer which is to be polymerized of a radical initiator. Radical initiators selected from among the same groups as aforementioned can be used in this case. The radical initiator may be introduced after the addition of the ethylenic unsaturated monomer has been completed, or it may be added at the same time as, or before, the addition of the ethylenic unsaturated monomer.

Furthermore, the aforementioned emulsifying agents can also be added for the polymerization reaction.

The polymerization initiator, the concentration, the polymerization temperature and the reaction time, for example, can, of course, be changed easily over a wide range in the polymerization reaction of the ethylenic unsaturated monomer of this present invention.

The extent of polymerization of the polymer dispersion during the addition of the ethylenic unsaturated monomer of the present invention is preferably high, and a level of from 80% to 100% is desirable, and a level of from 95% to 100% is especially desirable.

As described earlier, in the present invention the amount of ethylenic unsaturated monomer which has a sulfinic acid group which is added with respect to the total amount of quaternary ammonium salt in the polymer dispersion can be varied, as required, but it is preferably from 0.1 to 70 mol %, and most desirably from 1 to 50 mol %.

Furthermore, an ethylenic unsaturated monomer which has no sulfinic acid groups which can be used conjointly can be added in any amount, as required, but the amount added is preferably from 0 to 200 mol %, and most desirably from 0 to 100 mol %, with respect to the monomer which has sulfinic acid groups.

The distinguishing feature of the method of polymerization of the present invention is that the anionic monomer is first added to the cationic polymer dispersion and then polymerized in order to form a coexisting anionic polymer. As a result of this, it is possible to obtain a stable polymer dispersion even in the presence of the anionic polymer.

Furthermore, all of the manufacturing processes of the water based polymer dispersion of the present invention can be carried out in a single vessel and production is very simple, and there is no need for the use of large quantities of solvent.

Examples of the preparation of water based polymer dispersions of this present invention are described below.

Unless otherwise indicated, all percents, ratios, parts, etc. are by weight.

Synthesis Example 1: Preparation of Illustrative Compound (1)

Preparation of the Dispersion of polymer (1-a)

Distilled water (1750 ml) was introduced into a reactor, the air was removed with nitrogen gas, 60 ml of "Nissantrax H-45" (30% aqueous solution), 290.0 grams (1.9 mol) of chloromethylstyrene and 13.0 grams (0.1 mol) or divinylbenzene were added and the mixture was heated to 60° C. A liquid obtained by adding 2.5 grams of potassium persulfate to 100 ml of water from which the air had been removed with nitrogen and a liquid obtained by adding 0.95 gram of sodium hydrogen sulfite to 25 ml of distilled water from which the air had been removed with nitrogen were added simultaneously and the heating was continued, with agitation, for a period of 2 hours. Moreover, a mixture of the same amounts as described above of potassium persulfate and sodium sulfite were then added, the temperature was raised to 70° C. and the heating was continued, with agitation, for a period of 3 hours.

The latex so obtained was cooled to room temperature, 800 ml of distilled water was added and 173 grams (1.7 mol) of N-methylmorpholine was added. Then, the temperature was raised slowly to 70° C. and the mixture was heated, with agitation, for a period of 2 hours. The mixture was then cooled to room temperature and filtered, the residual inorganic salts and N-methylmorpholine were removed by ultrafiltration and a polymer dispersion (Dispersion of Polymer (1-a)) was obtained.

The solid fraction concentration of the polymer obtained was 8.9 wt %, and the cationized nitrogen atom content, by titration, was $2.73\times10^{-4}$ (mol/gram of latex). Furthermore, the latex particle diameter was 127 nm (measured using a Coulter Sub-micron Particle Analyzer, made by the Nikkaki Co.)

Polymerization of Potassium Styrenesulfinate in the Dispersion of Polymer (1-a)

The dispersion of polymer (1-a) (200 grams) was introduced into a reactor and a solution obtained by dissolving 1.13 grams of potassium styrenesulfinate (the amount equivalent to an $-SO_2K$/total nitrogen content ratio of 1/10) in 20 grams of distilled water was added dropwise over a period of 2 minutes while agitating the dispersion at room temperature under a blanket of nitrogen. Once the drip feed had been completed, the temperature was raised to 70° C. and a solution obtained by dissolving 0.05 gram of 2,2'-azobis(2-amidinopropane) hydrochloride (marketed by the Wako Pure Chemical Industries, Ltd. under the trade name "V-50") in 5 ml of distilled water was added twice at intervals of an hour, and then the temperature was raised to 80° C. and the mixture was agitated for a period of 3 hours. After cooling, the mixture was filtered and a water based polymer dispersion of solid fraction concentration 8.80% and particle diameter 115 nm was obtained.

SYNTHESIS EXAMPLES 2 AND 3

Polymer dispersions were obtained in the same way as for Synthesis Example 1 except that the amount of potassium styrenesulfinate which was added to the same polymer (1-a) as in Synthesis Example 1 was varied as shown in Table 1. The results obtained are summarized in Table 1.

In Synthesis Examples 1 to 3, no deposited material due to the aggregation of particles was observed at all on the walls of the flask or on the agitator blades during the polymerization of the potassium styrenesulfinate, and the dispersions obtained had a low viscosity and were very stable.

TABLE 1

| Synthesis Example | Acid Monomer (Type) | (Amount Added) (grams) | $-SO_2K$/Total Nitrogen Atom Content (mol ratio) | Solid Fraction Concentration (wt %) | Particle Size (nm) | Remarks |
|---|---|---|---|---|---|---|
| 1 | Potassium styrenesulfinate | 1.13 | 1/10 | 8.82 | 115 | Illust. Cpd. (1) |
| 2 | As above | 2.25 | 1/5 | 9.32 | 113 | Illust. Cpd. (2) |
| 3 | As above | 3.38 | 3/10 | 9.92 | 116 | |

SYNTHESIS EXAMPLES 4 TO 6

Preparation of the Dispersion of Polymer (5-a)

Distilled water (1750 ml) was introduced into a reactor, the air was removed with nitrogen gas, 60 ml of "Nissantrax H-45" (30% aqueous solution), 13.0 grams (0.1 mol) of divinylbenzene, 98.9 grams (0.95 mol) of styrene and 145.0 grams (0.95 mol) of chloromethylstyrene were added and the mixture was heated to 60° C. A liquid obtained by adding 2.5 grams of potassium persulfate to 100 ml of distilled water from which the air had been removed with nitrogen and a liquid obtained by adding 0.95 gram of sodium hydrogen sulfite to 25 ml of distilled water from which the air had been removed were added simultaneously and the mixture was heated with agitation for a period of 2 hours. Moreover, a mixed liquid containing just the same quantities as described above of potassium persulfate and sodium sulfite was added, the temperature was raised to 70° C. and the mixture was heated, with agitation, for a further period of 3 hours.

The latex so obtained was cooled to room temperature, 800 ml of distilled water was added and 94.2 grams (0.95 mol) of N-methylpiperidine was added. The temperature was then raised gradually to 70° C. and the mixture was heated, with agitation, for a period of 2 hours. The mixture was filtered after cooling to room temperature. The residual inorganic salts and N-methylpiperidine were removed by ultrafiltration and a polymer dispersion (Dispersion of Polymer (5-a)) was obtained.

The polymer obtained had a solid fraction concentration of 9.2 wt % and the cationized nitrogen atom content of the polymer measured by titration was $1.93\times10^{-4}$ (mol/gram of latex).

Polymerization of Potassium Styrenesulfinate in the Dispersion of Polymer (5-a)

The target polymer dispersions were obtained in the same way as in Synthesis Example 1 except that the amount of potassium styrenesulfinate was varied and the dispersion of polymer (5-a) was used. The results obtained on preparing a series of dispersions with different quantities of potassium styrenesulfinate (Synthesis Examples 4, 5 and 6) are shown in Table 2.

No deposited material due to the aggregation of particles was observed at all on the walls of the flask or on the agitator blades during the polymerization of the potassium styrenesulfinate in these examples, and the dispersions obtained had a low viscosity and were very stable.

TABLE 2

| Synthesis Example | Amount of Potassium Styrenesulfinate Added (grams) | $-SO_2K$/ Total Nitrogen Atom Content (mol ratio) | Solid Fraction Concentration (wt %) | Particle Size (nm) | Remarks |
|---|---|---|---|---|---|
| 4 | 0.80 | 1/10 | 8.46 | 116 | Illust. Cpd (5) |
| 5 | 1.59 | 1/5 | 8.68 | 116 | |
| 6 | 2.39 | 3/10 | 8.96 | 120 | Illust. Cpd. (6) |

SYNTHESIS EXAMPLE 7

Preparation of the Dispersion of Polymer (8-a)

Distilled water (350 ml) was introduced into a reactor, the air was removed with nitrogen gas, 12 ml of "Nissantrax H-45" (30% aqueous solution), 2.6 grams (0.02 mol) of divinylbenzene, 19.8 grams (0.19 mol) of styrene and 29.0 grams (0.19 mol) of chloromethylstyrene were added and the mixture was heated to 60° C. A liquid obtained by adding 0.5 gram of potassium persulfate to 20 ml of distilled water from which the air had been removed with nitrogen and a liquid obtained by adding 0.19 gram of sodium hydrogen sulfite to 5 ml of distilled water from which the air had been removed were added simultaneously and the mixture was heated, with agitation, for a period of 2 hours. Moreover, a mixed liquid containing just the same quantities as described above of potassium persulfate and sodium sulfite was added, the temperature was raised to 70° C. and the mixture was heated, with agitation, for a further period of 3 hours.

The latex so obtained was cooled to room temperature, 160 ml of distilled water was added and 19.2 grams (0.19 mol) of triethylamine was added. The temperature was then raised gradually to 70° C. and the mixture was heated, with agitation, for a period of 2 hours. The mixture was filtered after cooling to room temperature, the residual inorganic salts and triethylamine were removed by ultrafiltration and a polymer dispersion (Dispersion of Polymer (8-a)) was obtained.

The polymer obtained had a solid fraction concentration of 9.5 wt % and the cationized nitrogen atom content of the polymer measured by titration was $2.00\times10^{-4}$ (mol/gram of latex).

Polymerization of Potassium Styrenesulfinate in the Dispersion of Polymer (8-a)

The dispersion of polymer (8-a) (200 grams) was introduced into the reactor, and 1.65 grams of potassium styrenesulfinate (the quantity required to provide an $-SO_2K$/total nitrogen content ratio of 1/5) dissolved in 20 grams of distilled water was added dropwise over a period of 2 minutes while agitating the dispersion at room temperature under a blanket of nitrogen. After the drip feed had been completed, the mixture was heated to 70° C. and a solution obtained by dissolving 0.05 gram of 2,2'-azobis(2-amidinopropane) hydrochloride (marketed by the Wako Pure Chemical Industries, Ltd. under the trade name V-50) in 5 ml of distilled water was added twice at intervals of an hour, and then the temperature was raised to 80° C. and the agitation was continued for a further period of 3 hours. The mixture was filtered after cooling, and a water based polymer dispersion with a solid fraction concentration of 9.0 wt % and a particle diameter of 108 nm was obtained.

No deposited material due to the aggregation of particles was observed at all on the walls of the flask or on the agitator blades during the polymerization of the potassium styrenesulfinate in this Synthesis Example 7, and the dispersion obtained had a low viscosity and was very stable.

The water based polymer dispersions (polymer mordants) of the present invention are used as mordants in color diffusion transfer type applications, and especially as mordants for use in peel-apart type color diffusion transfer applications, but they can also be used as mordants in thermal development type photosensitive materials. Furthermore, they can also be used as anti-halation layer dye mordants of the type disclosed in U.S. Pat. No. 3,282,699.

The layer comprised of a polymer of the present invention may be formed of a film of the polymer itself, but it may also include various natural or synthetic hydrophilic polymers which are generally used in the field of photography, such as gelatin, poly(vinyl alcohol) and polyvinylpyrrolidone, for example, (the inclusion of poly(vinyl alcohol) is especially desirable). Two or more polymer mordants of the present invention (for example, a combination a polymer mordant and a polymer dispersion mordant) can be used conjointly in one layer or in two or more layers, or the polymer mordants can be mixed with another mordant and used in the same layer or the polymer mordants and the other mordant can be used in separate layers in the same photographic element. Furthermore, the polymer mordants of the present invention can also be used in the excess dye trapping mordant layers disclosed in U.S. Pat. 3,930,864. Mordants which can be used with the polymer mordants of the present invention include those disclosed, for example, in U.S. Pat. Nos. 4,131,469 and 4,147,548, JP-A-52-136626, JP-A-54-126027 and JP-A-54-145529.

The amount of the polymer mordant used can be determined easily by those in the industry according to the amount of dye which is to be mordanted, the type and composition of the polymer mordant and the image forming process which is to be used for example, but as a guide, the polymer mordant(s) of the present invention and, if any, the other mordant(s) account for from about 20 to 80 wt % of the mordant layer or they are included at a rate of from about 0.5 to 15 g/m$^2$, and preferably they account for from 40 to 60 wt % of the mordant layer or they are preferably included at a rate of from 1 to 10 g/m$^2$.

A color diffusion transfer method which is one useful practical embodiment of this present invention is described below.

Embodiments in which an image receiving element and a photosensitive element are laminated on a single transparent support and with which there is no need to peel the photosensitive element from the image receiving element after completion of the transfer image are typical embodiments of film units in which the color diffusion transfer method is used. In more practical terms, the image receiving layer is comprised of at least a mordant layer, and a preferred embodiment of a photosensitive element has a combination of a blue sensitive emulsion layer, a green sensitive emulsion layer and a red sensitive emulsion layer, or a combination of a green sensitive emulsion layer, a red sensitive emulsion layer and an infrared sensitive emulsion layer, or a combination of a blue sensitive emulsion layer, a red sensitive emulsion layer and an infrared sensitive emulsion layer, with a yellow dye providing compound, a magenta dye providing compound and a cyan dye providing compound associated with each of the aforementioned emulsion layers respectively (here, the term "infrared sensitive emulsion layer" signifies an emulsion layer which is sensitive to light of wavelengths greater than 700 nm, and especially to light of wavelengths greater than 740 nm). Moreover, a white reflecting layer which contains a solid pigment such as titanium oxide can be established between the mordant layer and the photosensitive layer or dye providing compound containing layer so as to render the transfer image more visible through the transparent support.

A light shielding layer may be established between the white reflecting layer and the photosensitive layer so that development processing can be completed in a light place. Furthermore, a peeling layer may be established at a suitable location so that all or part of the photosensitive element can be peeled away from the image receiving element, as required (such embodiments have been disclosed, for example, in JP-A-56-67840 and Canadian Patent 674,082). Furthermore, there are laminated peel-apart type embodiment color diffusion transfer film units as disclosed in JP-A-63-226649 which are comprised of a photosensitive element which has established sequentially on a white support at least (a) a layer which has a neutralizing function, (b) a dye image receiving layer, (c) a peeling layer and (d) at least one silver halide emulsion layer which has incorporated a dye image forming substance; an alkali processing composition which contains a light shielding agent; and a transparent cover sheet, which are characterized by having a layer which has a light shielding function on the opposite side of the emulsion layer to that on which the processing composition is spread.

Furthermore, color diffusion transfer photographic film units comprising a photosensitive element which has established sequentially on a white support at least (a) a dye image receiving layer, (b) a peeling layer and (c) at least one silver halide emulsion layer with which a dye image forming substance is associated; an alkali processing composition which contains a light shielding agent; and a transparent cover sheet which has at least a layer which has a neutralizing function on the side on which the processing composition is spread have been disclosed in Japanese Patent Application No. 63-120201 (corresponding to JP-A-1-289950).

Furthermore, in another embodiment in which peeling apart is not required, the aforementioned photosensitive element is established by coating on a single transparent support and a white reflecting layer is established by coating over the top of this, and then, an image receiving layer is laminated over the top of this layer. An embodiment with which peeling off of the photosensitive element from the image receiving element is intended in which an image receiving layer, a white reflecting layer, a peeling layer and a photosensitive element are all laminated onto the same support has been disclosed in U.S. Pat. No. 3,730,718.

On the other hand, typical embodiments in which the photosensitive element and the image receiving element are established by coating independently on two supports can be broadly classified into two types, namely peel-apart types and types with which peeling apart is not required. More precisely, in the preferred embodiment of a peel-apart type film unit, at least one image receiving layer is established by coating on a support and a photosensitive element is also established by coating on a support with a light shielding layer, and prior to completing the exposure, the coated surface of the photosensitive emulsion layer is not aligned facing the mordant layer coated surface but, after the exposure has been completed (for example, during development processing) the photosensitive layer coated surface is inverted and manipulated in such a way that it lies upon the image receiving layer coated surface. The photosensitive layer is peeled away from the image receiving layer quickly once the transfer image has been completed in the mordant layer.

Furthermore, in the preferred embodiment of the film unit in which peeling apart is not required, at least one mordant layer is established by coating on a transparent support, and a photosensitive element is established by coating on a support which is transparent or which has a light shielding layer, and the photosensitive layer coated surface and the mordant layer coated surface are arranged facing each other with one superimposed on the other.

A rupturable container (processing element) which can be ruptured by the application of pressure which contains the alkali processing fluid can be combined in the embodiments described above. In film units of the type with which peeling apart is unnecessary where the image receiving layer and the photosensitive element are established on a single support, the processing element is preferably established between the photosensitive element and a cover sheet which is superimposed over the photosensitive element. Furthermore, in embodiments in which the photosensitive element and the image receiving element are each established by coating on different supports, the processing element is preferably established at the latest by the development processing time between the photosensitive element and the image receiving element. The inclusion in the processing element of a light shielding agent (carbon black or a dye which changes color according to the pH, for example) and/or a white pigment (for example, titanium oxide) is desirable, depending on the form of the film unit. Moreover, in color diffusion transfer photographic film units, a neutralization timing function comprising a neutralizing layer and a neutralization timing layer is preferably incorporated into the cover sheet or into the image receiving element, or alternatively into the photosensitive element.

Hard material such as glass and ceramics, and flexible materials such as papers and films make good supports for the construction of image receiving elements, and in any case the selection of a support which is not liable to pronounced dimensional change during storage or processing is of importance. Such supports may be transparent or opaque, and examples include polyester films, polycarbonate films, polystyrene films, cellulose derivative films, paper, baryta paper, papers which have been coated with pigments such as titanium white, for example, and papers of which the surfaces have been laminated with a polymer such as polyethylene, polystyrene or a cellulose derivative, for example.

A neutralizing function is preferably incorporated between the support and the photosensitive layer, or between the support and the image receiving layer, or over the cover sheet, in the color diffusion transfer type film units in the present invention.

The layer which has a neutralizing function is a layer which contains a sufficient quantity of an acidic substance to neutralize the alkali which is introduced from the processing composition, and it may consist of a multilayer which incorporates a neutralization rate controlling layer (timing layer) and an adhesion reinforcing layer, as required. The acidic substance preferably has acidic groups of which the pKa value is not more than 9 (or precursor groups which give rise to such acidic groups as a result of hydrolysis), and the most desirable acidic substances include the higher fatty acids such as oleic acid disclosed in U.S. Pat. No. 2,983,606, polymers of acrylic acid, methacrylic acid or maleic acid and their partial esters or acid anhydrides as disclosed in U.S. Pat. No. 3,326,819, copolymers of acrylic acid and acrylic acid esters as disclosed in French Patent 2,290,699, and acidic latex type polymers such as those disclosed in U.S. Pat. No. 4,139,383 and in *Research Disclosure,* No. 16102 (Sept., 1977).

Other acidic substances such as those disclosed, for example, in U.S. Pat. No. 4,088,493, JP-A-52-153739, JP-A-53-1023, JP-A-53-4540, JP-A-53-4541 and JP-A-53-4542 can also be used for this purpose.

Actual examples of acidic polymers include copolymers of ethylene and vinyl monomers such as vinyl acetate and vinyl methyl ether with maleic anhydride and its n-butyl ester, copolymers of butyl acrylate and acrylic acid, and cellulose acetate hydrodienephthalate.

The aforementioned polymer acids can be used in the form of mixtures with hydrophilic polymers. Polymers of this type include, for example, polyacrylamide, polyvinylpyrrolidone, poly(vinyl alcohol) (including partially saponified materials), carboxymethylcellulose, hydroxymethylcellulose, hydroxyethylcellulose and poly(methyl vinyl ether). Poly(vinyl alcohol) is preferred from among these polymers.

The amount of polymer acid coated is adjusted according to the amount of alkali which is to be spread on the photosensitive element. The equivalent ratio of polymer acid and alkali per unit area is preferably from 0.9 to 2.0. The color of the transferred dyes may change if the amount of polymer acid is too small and staining may occur in the white background, while there may be an adverse effect on changes of color or the resistance of the image to light in the presence of too much polymer acid. The equivalent ratio is most desirably from 1.0 to 1.3. The admixture of too much or too little hydrophilic polymer can also result in a lowering of the quality of the photograph. The ratio by weight of hydrophilic polymer with respect to the polymer acid is from 0.1 to 10, and preferably from 0.3 to 3.0.

Additives can be incorporated for various purposes into the layer which has a neutralizing function in this invention. For example, the hardening agents known in the industry can be added to harden this layer, and poly-hydroxy compounds such as polyethylene glycol, polypropylene glycol and glycerine, for example, can be added to improve the film with respect to brittleness. Anti-oxidants, brightening agents and dyes for providing a blue tint, for example, can also be added, as required.

The timing layer which is used in combination with a neutralizing layer may be comprised of a polymer which has a low alkali permeability, such as gelatin, poly(vinyl alcohol), partially acetalated poly(vinyl alcohol), cellulose acetate or partially hydrolyzed poly(vinyl acetate), a latex polymer which has a high activation energy for alkali permeation formed by copolymerization with a small amount of a hydrophilic comonomer such as acrylic acid monomers, or polymers which have lactone rings, for example.

From among these materials, timing layers in which cellulose acetate is used are disclosed, for example, in JP-A-54-136328 and U.S. Pat. Nos. 4,267,262, 4,009,030 and 4,029,849. The latex polymers made by copolymerizing small quantities of a hydrophilic comonomer such as acrylic acid are disclosed, for example, in JP-A-54-128335, JP-A-56-69629, JP-A-57-6843, and U.S. Pat. Nos. 4,056,394, 4,061,496, 4,199,362, 4,250,243, 4,256,827 and 4,268,604. The polymers which have lactone rings are disclosed in U.S. Pat. No. 4,229,516, and the other polymers are disclosed, for example, in JP-A-56-25735, JP-A-56-97346, JP-A-57-6842, EP-A-31957, EP-A-37724 and EP-A-48412 are especially useful.

The other polymers disclosed in the literature indicated below can also be used as the materials for the timing layers:

U.S. Pat. Nos. 3,421,893, 3,455,686, 3,575,701, 3,778,265, 3,785,815, 3,847,615, 4,088,493, 4,123,275, 4,148,653, 4,201,587, 4,288,523, 4,297,431, West German Patent Application (OLS) Nos. 1,622,936 and 2,162,277, and *Research Disclosure,* No. 15162 (Nov., 1976).

The timing layers in which these materials are used may be individual layers, or two or more types of layer can be used conjointly.

Furthermore, the development inhibitors and/or precursors thereof disclosed, for example, in U.S. Pat. No. 4,009,029, West German Patent Application (OLS) Nos. 2,913,164 and 3,014,672, JP-A-54-155837 and JP-A-55-138745, and the hydroquinone precursors, other photographically useful additives and precursors thereof disclosed in U.S. Pat. No. 4,201,578, can be combined in the timing layers which are comprised of the aforementioned materials.

With peel-apart type diffusion transfer photographic systems of the type in which the photosensitive layer and the dye receiving layer are established by coating on separate supports, a peeling layer is established as a film over the image receiving layer (on the processing fluid spreading side) in order to facilitate peeling when peeling the image receiving sheet away from the photosensitive sheet and to prevent the processing fluid forming a film and becoming attached to or remaining on the image receiving layer.

Furthermore, with the peel-apart type photographic film units of the type disclosed in JP-A-63-226649 and Japanese Patent Application No. 63-120201 (corresponding to JP-A-1-289950) (referred to hereinafter as peelable mono-sheets) a peeling layer is established between the emulsion layer with which the dye image forming substance is combined and the dye image receiving layer, and the emulsion layer is peeled away after processing. Hence, the peeling layer must maintain the contact between the image receiving layer and the emulsion layer in the unprocessed state and facilitate peeling apart after processing. The materials disclosed, for example, in JP-A-47-8237, JP-A-59-220727, JP-A-59-229555, JP-A-60-214357, JP-A-49-4653, U.S. Pat. Nos. 3,220,835 and 4,359,518, JP-A-49-4334, JP-A-56-65133, JP-A-45-24075, and U.S. Pat. Nos. 3,227,550, 2,759,825, 4,401,746 and 4,366,227 can be used as materials for this purpose. Water soluble (or alkali soluble) cellulose derivatives are examples of such materials. Actual examples include hydroxyethylcellulose, cellulose acetate phthalate, plasticized methylcellulose, ethylcellulose, cellulose nitrate and carboxymethylcellulose. Other materials include various natural polymers, such as alginic acid, pectin and gum arabic, for example. Various modified gelatins, for example acetylated gelatin and phthalated gelatin, can also be used. Moreover, water soluble synthetic polymers are another type of material which can be used for this purpose. Examples of water soluble synthetic polymers include poly(vinyl alcohol), polyacrylate, poly(methyl methacrylate), poly(butyl methacrylate) and copolymers of these materials.

The peeling layer may be a single layer or it may be comprised of a plurality of layers, as disclosed, for example, in JP-A-59-220727 and JP-A-60-60642.

In those cases where the present invention is applied to color diffusion transfer applications, useful dye forming substances include non-diffusible compounds which release diffusible dyes (or dye precursors) in accordance with the silver image, or compounds of a type with which the diffusibility of the compound itself is changed in accordance with the silver image, and such compounds have been described in the fourth edition of "The Theory of the Photographic Process" (T. H. James, Macmillan Publishing Co., Inc., 1977). These compounds can all be represented by the general formula (III) which is shown below.

DYE—Y' (III)

Here, DYE represents a dye or a dye precursor, and Y' represents a component such that a compound which has a different diffusibility from the compound of formula (III) is formed under alkaline conditions. Depending on the function of Y', these compounds of formula (III) can be classified as negative type compounds with which diffusion occurs in the parts where the silver image is formed or positive type compounds with which diffusion occurs in the undeveloped parts.

Actual examples of Y' in negative type compounds include those which are oxidized as a result of development, break down and release a diffusible dye.

Actual examples of Y' have been disclosed, for example, in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322 and 4,139,389, JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342 and JP-A-57-119345.

N-Substituted sulfamoyl groups (with groups derived from an aromatic hydrocarbon ring or a heterocyclic ring for the N-substituent) are preferred for Y' in the negative type dye releasing redox compounds. Typical examples of Y' groups are indicated below, but the Y' group is not limited to these groups.

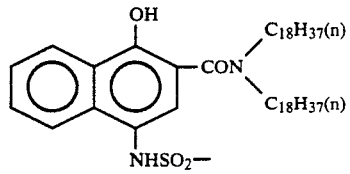

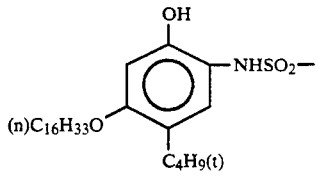

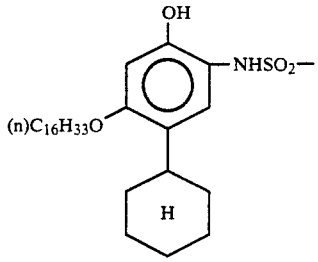

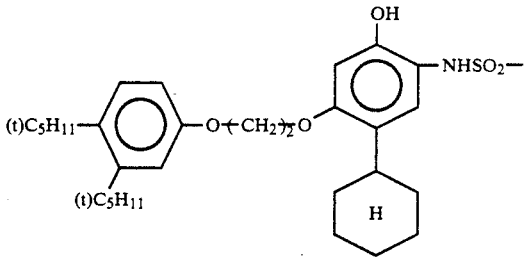

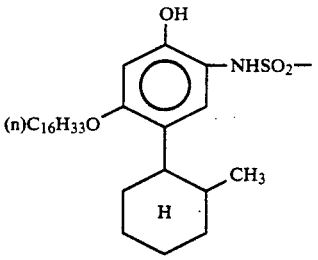

Positive type compounds have been described in *Angev. Chem. Inst. Ed. Engl.*, 22, 191 (1982).

Actual examples include compounds (dye developing agents) which are diffusible initially under alkaline conditions but which are rendered nondiffusible on oxidation due to development. The groups disclosed in U.S. Pat. No. 2,983,606 are typical of Y' groups which are effective in compounds of this type.

Furthermore, the compounds of formula (III) can be compounds of other type which undergo spontaneous ring closure under alkaline conditions and release a diffusible dye, but when oxidized in the course of development release essentially no dye at all. Actual examples of Y' groups which provide such a function have been disclosed, for example, in U.S. Pat. No. 3,980,479, JP-A-53-69033, JP-A-54-130927, and U.S. Pat. Nos. 3,421,964 and 4,199,355.

Furthermore, the compounds of formula (III) can be compounds of other type which do not themselves release a dye but do release a dye when they have been reduced. Compounds of this type are used together with an electron donor, and a diffusible dye is released in the form of the image by reaction with the residual electron donor which has been oxidized in the form of the image by silver development. Atomic groups which have such a function have been disclosed, for example, in U.S. Pat. Nos. 4,183,753, 4,142,891, 4,278,750, 4,139,379 and 4,218,368, JP-A-53-110827, U.S. Pat. Nos. 4,278,750, 4,356,249 and 4,358,525, JP-A-53-110827, JP-A-54-130927, JP-A-56-164342, Kokai Giho 87-6199 and EP-A-220746.

Actual examples of these compounds are indicated below, but the compounds are not limited to these examples.

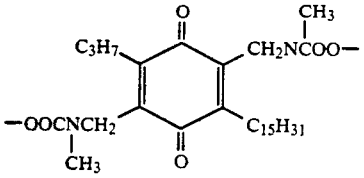

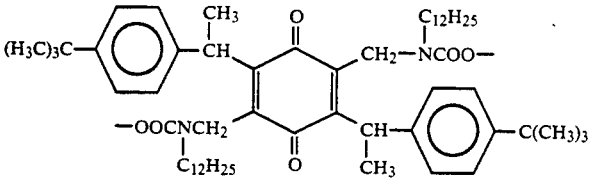

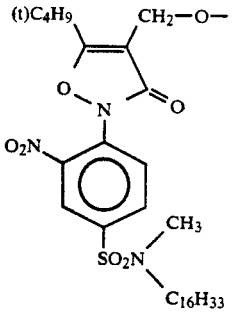

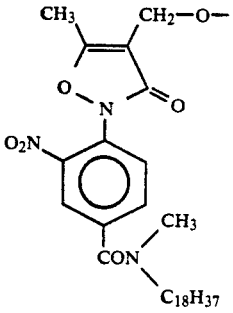

In those cases where compounds of this type are used they are preferably used in combination with nondiffusible electron donating compounds (commonly known as ED compounds) or precursors thereof. Examples of ED compounds have been disclosed, for example, in U.S. Pat. Nos. 4,263,393 and 4,278,750, and JP-A-56-138736.

Actual examples of dye image forming substances of still another type as indicated below can also be used.

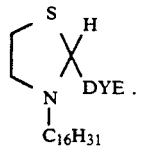

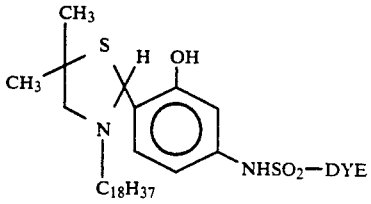

(In these formula, DYE is a dye or dye precursor as described earlier)

Details have been disclosed in U.S. Pat. Nos. 3,719,489 and 4,098,783.

On the other hand, actual examples of dyes which can be represented by DYE in the aforementioned general formula have been disclosed in the literature indicated below.

Examples of Yellow Dyes

Those disclosed in U.S. Pat. Nos. 3,597,200, 3,309,199, 4,013,633, 4,245,028, 4,156,609, 4,139,383, 4,195,992, 4,148,641, 4,148,643 and 4,336,322, JP-A-51-14930, JP-A-56-71072, and *Research Disclosure,* No. 7630 (Dec., 1978) and *ibid.,* No. 16475 (Dec., 1977)

Examples of Magenta Dyes

Those disclosed in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, JP-A-52-106727, JP-A-53-23628, JP-A-55-36804, JP-A-56-73057, JP-A-56-71060 and JP-A-55-134.

Examples of Cyan Dyes

Those disclosed in U.S. Pat. Nos. 3,482,972, 3,929,760, 4,013,635, 4,268,625, 4,171,220, 4,242,435, 4,142,891, 4,195,994, 4,147,544 and 4,148,642, British patent 1,551,138, JP-A-54-99431, JP-A-52-8827, JP-A-53-47823, JP-A-53-143323, JP-A-54-99431, JP-A-56-71061, European Patents (EPC) 53,035 and 53,040, *Research Disclosure,* No. 17630 (Dec., 1978) and *ibid.,* No. 16475 (Dec., 1977).

The silver halide emulsions used in the color diffusion transfer method in the present invention may be negative type emulsions with which the latent image is formed principally on the surface of the silver halide grains, or of the internal latent image direct positive type with which the latent image is formed within the silver halide grains.

So-called "conversion type" emulsions which have been prepared on the basis of the difference in solubility of the silver halides, and "core/shell" emulsions in which at least the sensitivity sites of core grains of silver halide which have been doped with metal ions, chemically sensitized, or both doped with metal ions and chemically sensitized are covered with an outer shell of silver halide can be used, for example, as internal latent image type direct positive emulsions, and these have been disclosed, for example, in U.S. Pat. Nos. 2,592,250 and 3,206,313, British Patent 1,027,146, U.S. Pat. Nos. 3,761,276, 3,935,014, 3,447,927, 2,497,875, 2,563,785, 3,551,662, 4,395,478, West German patent 2,728,108 and U.S. Pat. No. 4,431,730.

Furthermore, it is necessary to provide fogging nuclei at the surface using light or a nucleating agent after imagewise exposure in those cases where an internal latent image type direct positive emulsion is used.

Examples of nucleating agents which can be used for this purpose include the hydrazines disclosed in U.S. Pat. Nos. 2,563,785 and 2,588,982, the hydrazides and hydrazones disclosed in U.S. Pat. No. 3,227,552, the heterocyclic quaternary salt compounds disclosed, for example, in British Patent 1,283,835, JP-A-52-69613 and U.S. Pat. Nos. 3,615,615, 3,719,494, 3,734,738, 4,094,683 and 4,115,122, the sensitizing dyes which have substituent groups which have a nucleating action within the dye molecule disclosed in U.S. Pat. No. 3,718,470, the thiourea bond type acylhydrazine based compounds disclosed, for example, in U.S. Pat. Nos. 4,030,925, 4,031,127, 4,245,037, 4,255,511, 3,266,013 and 4,276,364, and British Patent 2,012,443, and the acylhydrazine based compounds which have thioamido rings or heterocyclic groups such as triazole and tetrazole, for example, as adsorption groups disclosed, for example, in U.S. Pat. Nos. 4,080,270 and 4,278,748, and British Patent 2,011,391B can be used as nucleating agents for this purpose.

Spectrally sensitizing dyes are used in combination with the negative type emulsions and internal latent image type direct positive emulsions in this present invention. Actual examples have been disclosed, for example, in JP-A-59-180550, JP-A-60-140335, *Research Disclosure* (RD) 17029, and U.S. Pat. Nos. 1,846,300, 2,078,233, 2,089,129, 2,165,338, 2,231,658, 2,917,516, 3,352,857, 3,411,916, 2,295,276, 2,481,698, 2,688,545, 2,921,067, 3,282,933, 3,397,060, 3,660,103, 3,335,010, 3,352,680, 3,384,486, 3,623,881, 3,718,470 and 4,025,349.

At least two photosensitive layers in which emulsions which have been spectrally sensitized with the above mentioned spectrally sensitizing dyes are combined with the aforementioned dye image forming substances which provide dyes which has a selective spectral absorption in the same wavelength range as the emulsion are used to reproduce natural colors using the substractive color process. The emulsion and the dye image forming substance may be established by lamination coating in separate layers or they can be mixed together and established by coating as a single layer. In those cases where the dye image forming substance in the coated state absorbs in the spectrally sensitized region of the emulsion with which it is combined the dye image forming substance and the emulsion are preferably coated as separate layers. Furthermore, the emulsion layer may be comprised of a plurality of emulsion layers which have different photographic speeds, and layers may be established optionally between the emulsion layer and the dye image forming substance layer. For example, the establishment of a layer which contains a nucleation development accelerator as disclosed in JP-A-60-173541 and a spacing layer as disclosed in JP-B-60-15267 may increase the color image density, and the establishment of a reflecting layer as disclosed in JP-A-60-91354 can be used to raise the photographic speed of the photosensitive element.

In the preferred lamination coated structure, a unit incorporating a blue sensitive emulsion, a unit incorporating a green sensitive emulsion and a unit incorporating a red sensitive emulsion are arranged sequentially from the side from which the exposure is to be made.

Optional layers can be established between the emulsion layers, as required. The establishment of intermediate layers is desirable for preventing the effect of the development of one emulsion layer from having an adverse effect on another emulsion layer.

A non-diffusible reducing agent is preferably included in the intermediate layers in order to prevent diffusion of the oxidation product of the developing agent from occurring in those cases where a developing agent is used in combination with a non-diffusible dye image forming substance. Actual examples of such reducing agents include non-diffusible hydroquinones, sulfonamidophenols and sulfonamidonaphthols, and actual compounds have been disclosed, for example, in JP-B-50-21249, JP-A-50-23813, JP-A-49-106329, JP-A-49-129535, U.S. Pat. Nos. 2,336,327, 2,360,290, 2,403,721, 2,544,640, 2,732,300, 2,782,659, 2,937,086, 3,637,393 and 3,700,453, British Patent 557,750, JP-A-57-24941 and JP-A-58-21249. Methods for the dispersion of these compounds have been disclosed in JP-A-60-238831 and JP-B-60-18978.

The inclusion in the intermediate layers of compounds which capture silver ions is desirable in those cases where a compound with which a diffusible dye is released by the action of silver ion as disclosed in JP-B-55-7576 are used.

Furthermore, anti-irradiation layers, separating layers and protective layers, for example, can be established by coating as required.

Alkalis, thickeners and developing agents are included in the processing compositions which are used in the present invention, development accelerators and development inhibitors can be included for controlling development and anti-oxidants can be included to prevent deterioration of the developing agent, for example.

The alkali used is one which can provide a fluid pH of from 12 to 14, and alkali metal hydroxides (for example, sodium hydroxide, potassium hydroxide, lithium hydroxide), alkali metal phosphates (for example, potassium phosphate), guanidines and the hydroxides of quaternary amines (for example, tetramethylammonium hydroxide) can be used for this purpose. The use of potassium hydroxide and sodium hydroxide from among these substances is preferred.

A thickener is required to provide uniform spreading and to maintain the adhesion between the photosensitive layer and the cover sheet when the used photosensitive layer is being peeled away together with the cover sheet. Examples of thickeners include poly(vinyl alcohol), hydroxyethylcellulose and alkali metal salts of carboxymethylcellulose, and the use of hydroxyethylcellulose and sodium carboxymethylcellulose is preferred.

The preferred developing agents are any of those which permit cross oxidation with the dye image forming substance. Developing agents of this type can be used individually, or two or more types can be used conjointly, and these developing agents can also be used in the form of precursors. The developing agents can be included in an appropriate layer of the photosensitive element or they may be included in the alkali processing fluid. Actual examples of developing agents include aminophenols and pyrazolidones, and use of the pyrazolidones is especially desirable.

For example, use can be made of 1-phenyl-3-pyrazolidone, 1-p-tolyl-4,4-dihydroxymethyl-3-pyrazolidone, 1-(3'-methylphenyl)-4-methyl-4-hydroxymethyl-3-pyrazolidone, 1-phenyl-4-methyl-4-hydroxymethyl-3-pyrazolidone and 1-p-tolyl-4-methyl-4-hydroxymethyl-3-pyrazolidone.

Furthermore, with the peelable mono-sheet type diffusion transfer method, the unit is comprised of a white support having thereon a photosensitive element in which there are established sequentially at least (a) a layer which has a neutralizing function, (b) a dye image receiving layer, (c) a peeling layer and (d) at least one silver halide emulsion layer which is combined with a dye image forming substance; an alkali processing composition which contains a light shielding agent; and a transparent cover sheet, and there is a layer which has a light shielding function on the opposite side of the emulsion layer to that on which the processing composition is spread. Alternatively, the layer (a) on the white support in the structure described above which has a neutralizing function can be provided on the above mentioned transparent cover sheet. In this case, the layer which has a neutralizing function on the support can be removed. That is to say, with peelable mono-sheets the photosensitive layer and the dye image receiving layer are established by coating on the same support and, after imagewise exposure, the processing composition is spread and then the dye image which has been transferred to the dye image receiving layer is obtained by peeling off the dye image receiving element.

The term "white support" signifies a support of which at least the side on which the dye image receiving layer is established by coating is white, and any such support can be used provided that it has a satisfactory degree of whiteness and smoothness. For example, the white support may consist of a polymer film which has been whitened by the addition of a white pigment such as titanium oxide, barium sulfate or zinc oxide of particle size from 0.1 to 5 μm, or by the formation of microvoids by stretch. For example, the use of a film or synthetic paper consisting of poly(ethylene terephthalate), polystyrene or polypropylene which has been successively biaxially stretched to form a film in the usual way, or of a paper which has been laminated on both sides with polyethylene, poly(ethylene terephthalate), or polypropylene, for example, which contains titanium white is desirable.

The thickness of the support is from 20 to 350 μm, preferably from 70 to 210 μm, and most desirably from 80 to 150 μm. A light shielding layer can be established in the support if required. For example, use can be made of supports made by the lamination of polyethylene which contains a light shielding agent such as carbon black on the reverse side of a white support.

Carbon black which has been made using any method, for example using the channel method, the thermal method or the furnace method described by Donnet Voet in *Carbon black*, published by Marcel Dekker Inc., 1976, can be used for the raw material carbon black.

No particular limitation is imposed upon the particle size of the carbon black, but those which have a particle size from 90 to 1800 Å are preferred. The amount of black pigment added as a light shielding agent can be adjusted in accordance with the photographic speed of the photosensitive material which is to be shielded, but an amount which provides an optical density of some 5 to 10 is desirable.

The layer which has a neutralizing function, the dye image receiving layer and the photosensitive element are the same as those described earlier.

With peelable mono-sheet type diffusion transfer photographs it is possible to carry out processing in daylight by shielding the photosensitive layer from external light completely during development processing by means of the light shielding layer in the photosensitive element and the light shielding processing fluid which has been spread over the photosensitive element during processing. In practice, a layer which contains a light shielding agent may be established by coating on the reverse side of the support or between the photosensitive layer and the support, or a layer which contains a light shielding agent can be established within the support. Any substance which has a light shielding function can be used for the light shielding agent, but the use of carbon black is preferred.

Any binder can be used for establishing the light shielding layer by coating provided that carbon black can be dispersed in it, but the use of gelatin is preferred.

The shielding of the photosensitive layer from light may be achieved by shielding one side (surface) of the photosensitive layer by spreading a processing composition which has a light shielding function and by shielding the opposite side (surface) of the photosensitive layer by establishing a layer which contains a light shielding agent (a) between the photosensitive layer and the white support, (b) in the white support itself and/or (c) on the reverse side (the surface on the other side from the photosensitive layer) of the white support. At this time, light shielding can be achieved using (a), (b) and (c), and individually each of these methods may have an inadequate light shielding function.

The processing composition which is used for peelable mono-sheet type diffusion transfer photographs is one which can be spread uniformly over the photosensitive element after the photosensitive element has been exposed, co-operating with the light shielding layer which has been established on the reverse side of the support or the opposite side of the photosensitive layer to the processing liquid so that the photosensitive layer is completely shielded from external light, and which at the same time develops the photosensitive layer by means of components which are contained in the processing composition. For this purpose, alkalis, thickeners, developing agents, development accelerators and development inhibitors for controlling development and antioxidants for preventing the deterioration of the developing agent, for example, must be included in addition to the light shielding agent in the processing composition.

Any dyes and pigments, and combinations thereof, can be used as light shielding agents provided that they do not diffuse into the dye receiving layer and give rise to staining. Carbon black is typical of the materials which can be used, but combinations of titanium white and dyes can also be used. Dyes which have a temporary light shielding function in that they are decolorized after a fixed processing time can also be used.

A transparent cover sheet is provided to spread the processing fluid uniformly over the photosensitive element of a peelable mono-sheet type diffusion transfer photograph. The cover sheet can be peeled away together with the processing fluid and the used photosensitive layer after processing. Hence, it is subjected to a surface treatment or a suitable adhesive is established by coating so that it has adequate adhesion with the processing fluid. Furthermore, filter dyes can be included in the cover sheet and the photographic speed of the photosensitive layer can be controlled in this way. The filter dyes can be added directly to the cover sheet support or they can be coated in a separate layer.

The cover sheet support can be any of the smooth transparent supports normally used in photographic photosensitive materials, and cellulose acetate, polystyrene, poly(ethylene terephthalate) or polycarbonate, for example, can be used for this purpose. An underlayer may be established on the cover sheet support.

The under-layer coating liquids normally used in photographic photosensitive materials can be used for the under-layer. Furthermore, the cover sheet may also be provided with a layer which has a neutralizing function or a layer which captures dyes which have diffused to the cover sheet side.

The present invention is now illustrated in greater detail with reference to the following examples, but the present invention is not to be construed as being limited thereto. Unless otherwise indicated, all parts, percents, ratios, etc. are by weight.

EXAMPLE 1

Image Receiving Photosensitive Sheet I

The layers (A), (B) and (C) indicated below were established by coating on the reverse side of a polyethylene terephthalate (PET) support which contained titanium white pigment, and the layers (1) to (22) indicated below were coated on the opposite side of the support to provide an image receiving photosensitive sheet.

(A) A light shielding layer containing 2.0 g/m$^2$ of carbon black and 2.0 g/m$^2$ gelatin.

(B) A white layer containing 2.0 g/m$^2$ of titanium white and 0.7 g/m$^2$ of gelatin.

(C) A protective layer containing 0.09 g/m$^2$ of a spherical poly(methyl methacrylate) matting agent and 0.3 g/m$^3$ of gelatin.

(1) A mordant layer containing 3 g/m$^2$ of the polymer latex mordant indicated below and 3 g/m$^2$ of gelatin.

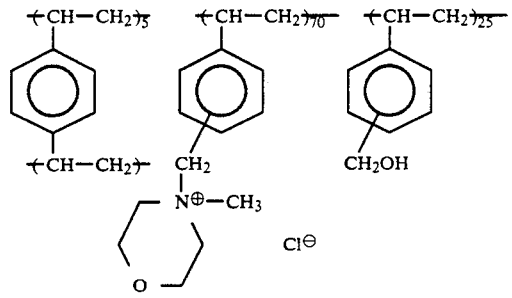

wherein 5:70:25 represents the mol ratio.

(2) A first peeling layer Comprised of 0.1 g/m$^2$ of the compound indicated below.

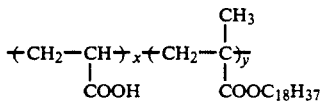

x/y = 75/25 (mol ratio)

(3) A second peeling layer comprised of 0.2 g/m$^2$ of a 51% acetylated cellulose acetate.

(4) A layer containing 1 g/m$^2$ of ethyl acrylate latex and 2.5 g/m$^2$ of gelatin.

(5) A layer containing 0.44 g/m$^2$ of the cyan dye releasing redox compound indicated below, 0.09 g/m$^2$ of tricyclohexyl phosphate, 0.008 g/m$^2$ of 2,5-di-tert-pentadecylhydroquinone, 0.05 g/m$^2$ of carbon black and 0.8 g/m$^2$ of gelatin.

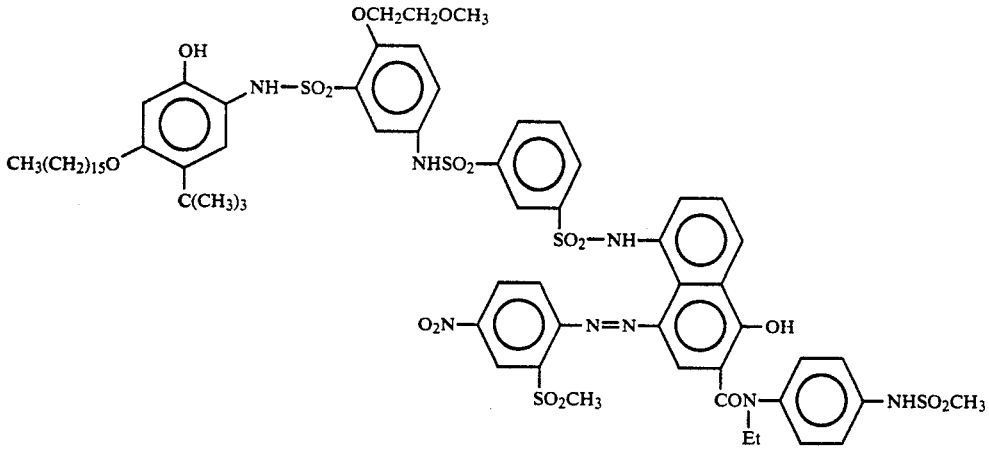

(6) A light reflecting layer containing 2 g/m$^2$ of titanium oxide and 0.5 g/m$^2$ of gelatin.

(7) A low speed red sensitive emulsion layer containing an internal latent image type direct positive octahedral silver bromide emulsion of grain size 1.0 μm (0.17 g/m$^2$ as silver), the red sensitive sensitizing dye as indicated hereinafter, 0.44 g/m$^2$ of gelatin, 1.2 μg/m$^2$ of the nucleating agent (NA) indicated below, and 0.022 g/m$^2$ of 2-sulfo-5-n-pentadecylhydroquinone.sodium salt.

NA

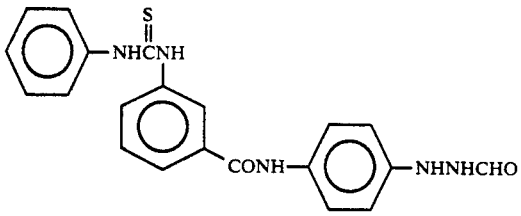

(8) A high speed red sensitive emulsion layer containing an internal latent image type direct positive octahedral silver bromide emulsion of grain size 1.6 μm (0.55 g/m$^2$ as silver), the red sensitive sensitizing dye indicated below, 0.88 g/m$^2$ of gelatin, 3.3 μg/m$^2$ of the same nucleating agent (NA) as used in layer (7), and 0.044 g/m$^2$ of 2-sulfo-5-n-pentadecylhydroquinone.sodium salt.

Red Sensitive Sensitizing Dye

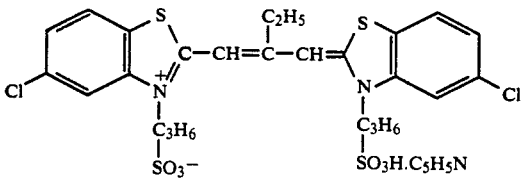

1.4 mg/gram of silver (9) A color stain preventing layer containing 1.2 g/m$^2$ of 2,5-di-tert-pentadecylhydroquinone, 1.2 g/m$^2$ of poly(methyl methacrylate) and 0.7 g/m$^2$ of gelatin.

(10) A layer containing 0.3 g/m$^2$ of gelatin.

(11) A layer containing 0.20 g/m$^2$ of the magenta dye releasing redox compound indicated below, 0.13 g/m$^2$ of tricyclohexyl phosphate, 0.012 g/m$^2$ of 2,5-di-tert-pentadecylhydroquinone and 1.2 g/m$^2$ of gelatin.

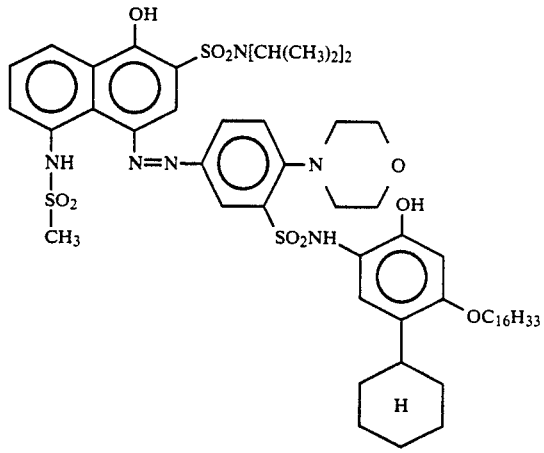

(12) A light reflecting layer containing 1 g/m$^2$ of titanium oxide and 0.25 g/m$^2$ of gelatin.

(13) A low speed green sensitive emulsion layer containing an internal latent image type direct positive octahedral silver bromide emulsion of grain size 1.0 μm (0.16 g/m$^2$ as silver), the green sensitive sensitizing dye as indicated hereinafter, 0.33 g/m$^2$ of gelatin, 1.4 μg/m$^2$ of the same nucleating agent (NA) as used in layer (7) and 0.026 g/m$^2$ of 2-sulfo-5-n-pentadecylhydroquinone.sodium salt.

(14) A high speed green sensitive emulsion layer containing an internal latent image type direct positive octahedral silver bromide emulsion of grain size 1.6 μm (0.53 g/m$^2$ as silver), the green sensitive sensitizing dye indicated below, 1.05 g/m$^2$ of gelatin, 2.6 μg/m$^2$ of the same nucleating agent (NA) as used in layer (7), and 0.06 g/m$^2$ of 2-sulfo-5-n-pentadecylhydroquinone.sodium salt.

Green Sensitive Sensitizing Dye

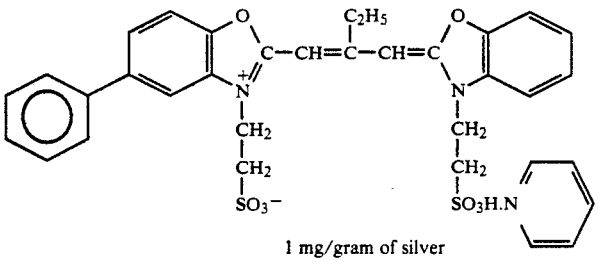

1 mg/gram of silver and

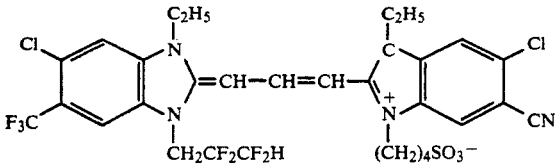

1 mg/gram of silver

(15) A color stain preventing layer containing 0.8 g/m$^2$ of 2,5-di-tert-pentadecylhydroquinone, 0.8 g/m$^2$ of poly(methyl methacrylate) and 0.45 g/m$^2$ of gelatin.

(16) A layer containing 0.3 g/m$^2$ of gelatin.

(17) A layer containing 0.85 g/m$^2$ of the yellow dye releasing redox compound indicated below, 0.21 g/m$^2$ of tricyclohexyl phosphate, 0.022 g/m$^2$ of 2,5-di-tert-pentadecylhydroquinone and 1.12 g/m$^2$ of gelatin.

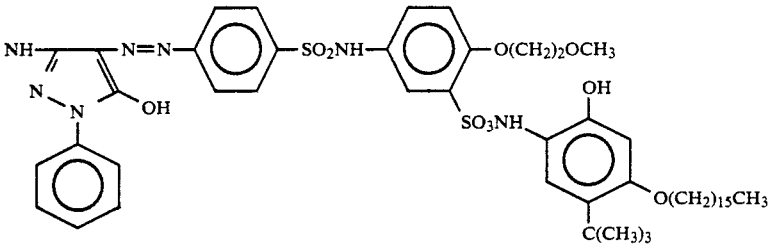

(18) A light reflecting layer containing 0.7 g/m$^2$ of titanium oxide and 0.18 g/m$^2$ of gelatin.

(19) A low speed blue sensitive emulsion layer containing an internal latent image type direct positive octahedral silver bromide emulsion of grain size 1.1 μm (0.38 g/m$^2$ as silver), the blue sensitive sensitizing dyes as indicated hereinafter, 0.6 g/m$^2$ of gelatin, 3 μg/m$^2$ of the same nucleating agent (NA) as used in layer (7) and 0.068 g/m$^2$ of 2-sulfo-5-n-pentadecylhydroquinone.sodium salt.

(20) A high speed blue sensitive emulsion layer containing an internal latent image type direct positive octahedral silver bromide emulsion of grain size 1.7 μm (0.71 g/m$^2$ as silver), the blue sensitive sensitizing dyes indicated below, 0.77 g/m$^2$ of gelatin, 5.6 μg/m$^2$ of the same nucleating agent (NA) as used in layer (7), and 0.043 g/m$^2$ of 2-sulfo-5-n-pentadecylhydroquinone.sodium salt.

Blue Sensitive Sensitizing Dyes

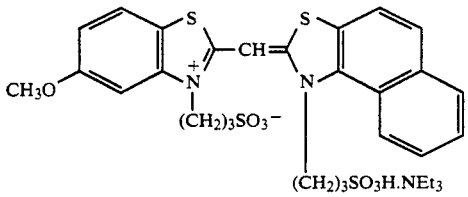

0.4 mg/gram of silver

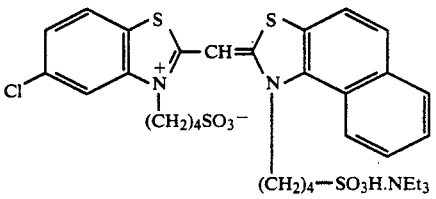

0.8 mg/gram of silver

(21) An ultraviolet absorbing layer containing $4\times10^{-4}$ mol/m$^2$ of each of the ultraviolet absorbers indicated below and 0.5 g/m$^2$ of gelatin.

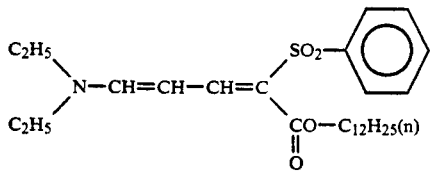

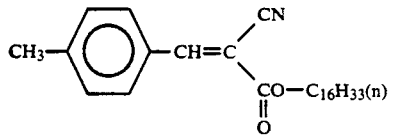

(22) A protective layer containing 40 mg/m$^2$ of matting agent and 1.0 g/m$^2$ of gelatin.

Image Receiving Photosensitive Sheets II-VI

These were prepared in the same way as the image receiving photosensitive sheet I except that layer (1) was modified in the ways indicated below.

II: A mordant layer containing 3.2 g/m$^2$ of Illustrative Compound (1) as a mordant and 3 g/m$^2$ of gelatin.

III: A mordant layer containing 3.4 g/m$^2$ of Illustrative Compound (2) as a mordant and 3 g/m$^2$ of gelatin.

IV: A mordant layer containing 3 g/m$^2$ of the polymer mordant indicated below and 3 g/m$^2$ of gelatin.

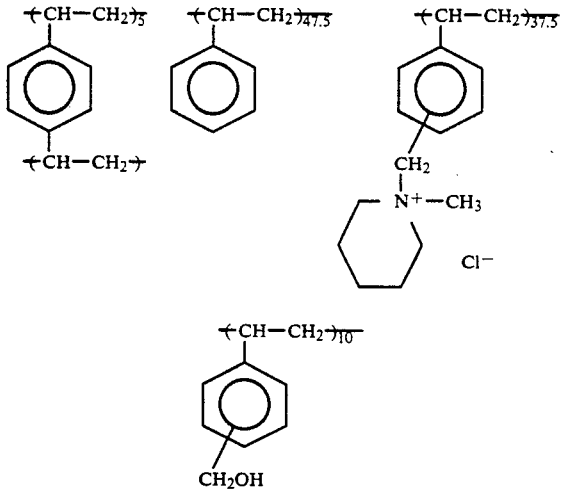

wherein 5:47.5:37.5:10 represents the mol ratio.

V: A mordant layer containing 3.1 g/m$^2$ of Illustrative Compound (5) as a mordant and 3 g/m$^2$ of gelatin.

VI: A mordant layer containing 3.4 g/m2$^2$ of Illustrative Compound (6) as a mordant and 3 g/m$^2$ of gelatin.

Cover Sheets

Cover sheets were obtained by establishing by coating the layers (1) to (3) indicated below on a transparent poly(ethylene terephthalate) support which contained a dye for the prevention of light piping and which had been provided with a gelatin under-layer.

(1) A neutralizing layer containing 10.4 g/m$^2$ of an acrylic acid/butyl acrylate (mol ratio 8:2) copolymer of average molecular weight 50,000 and 0.1 g/m$^2$ of 1,4-bis(2,3-epoxypropoxy)butane.

(2) A neutralization timing layer containing 2.9 g/m$^2$ of the copolymer indicated below and 0.29 g/m$^2$ of methyl vinyl ether/mono-methyl maleate copolymer.

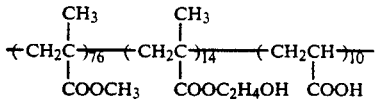

wherein 76:14:10 represents the mol ratio.

(3) A dye trapping layer containing 1 g/m$^2$ of the polymer latex mordant indicated below and 1 g/m$^2$ of gelatin.

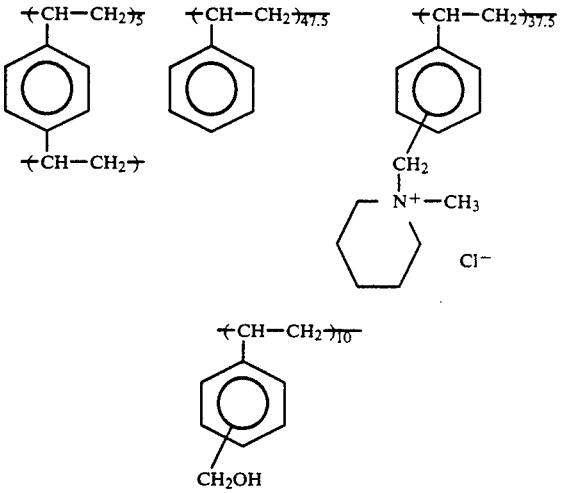

wherein 5:47.5:37.5:10 represents the mol ratio.

The aforementioned image receiving photosensitive sheets I to VI were exposed using a color test chart and laminated with the aforementioned cover sheet, spreading the processing fluid described below between the two sheets in such a way as to provide a thickness of 75 μm (the spreading was carried out with the aid of a pressure roller). Processing was carried out at 25° C. and samples were peeled apart 2 minutes 30 seconds and 10 minutes after processing. The peeling apart took place at the peeling layer in the photosensitive sheet and the colored image could be observed directly.

| Processing Fluid | |
|---|---|
| 1-Phenyl-4-hydroxymethyl-4-methyl-3-pyrazolidone | 15 g |
| Benzotriazole | 6 g |
| Potassium sulfite | 8 g |
| Hydroxyethylcellulose | 30 g |
| Potassium hydroxide | 64 g |
| Benzyl alcohol | 3.4 g |
| Carbon black | 150 g |
| Water | to make 1 kg |

The samples which has been peeled apart at each peeling time were left to stand for 2 hours under conditions of 25° C., 70% relative humidity (RH) after peeling apart and then measurements were made using a TCD densitometer made by the Fuji Photo Film Co., Ltd. The Maximum transfer density and the minimum density in each case was as shown in Table 3.

B, G and R signify the transfer densities measured using blue, green and red filters respectively.

TABLE 3

| Image Receiving Photosensitive Sheet | Peeled Apart at 2 min. 30 sec. Maximum Density B | G | R | Minimum Density G | Peeled Apart at 10 minutes Maximum Density B | G | R | Minimum Density B | G | R |
|---|---|---|---|---|---|---|---|---|---|---|
| I (Comp. Ex.) | 1.61 | 1.83 | 2.15 | 0.42 | 2.08 | 2.20 | 2.30 | 0.23 | 0.17 | 0.37 |
| II (Invention) | 1.60 | 1.82 | 2.16 | 0.28 | 2.08 | 2.19 | 2.32 | 0.22 | 0.16 | 0.35 |
| III (Invention) | 1.60 | 1.83 | 2.16 | 0.24 | 2.07 | 2.20 | 2.31 | 0.22 | 0.16 | 0.34 |
| IV (Comp. Ex.) | 1.62 | 1.89 | 2.20 | 0.40 | 2.12 | 2.28 | 2.38 | 0.23 | 0.18 | 0.39 |
| V (Invention) | 1.63 | 1.90 | 2.20 | 0.26 | 2.12 | 2.30 | 2.38 | 0.22 | 0.17 | 0.37 |
| VI (Invention) | 1.62 | 1.89 | 2.19 | 0.22 | 2.13 | 2.29 | 2.37 | 0.22 | 0.16 | 0.34 |

It is clear from Table 3 that there was no loss of maximum transfer density, less pink staining (represented by the minimum density G) when the unit is peeled apart after a short period of time, and a tendency for the minimum density to fall on peeling apart after 10 minutes when a mordant of the present invention had been used, and photographic images of excellent quality were obtained.

EXAMPLE 2

A 10 wt % aqueous gelatin solution (72 grams) was added to 81 grams of the dispersion of polymer (1-a) of Synthesis Example 1 and the mixture was diluted with the addition of 29 ml of water. A 5% aqueous solution of poly(potassium styrenesulfinate) was then added slowly to this liquid with agitation.

With just a small addition, the dispersion of polymer coagulated and it could not be used as a coating liquid.

It is clear that an anionic polymer such as poly(potassium styrenesulfinate) cannot be included in a quaternary ammonium type mordant layer using the normal method.

EXAMPLE 3

Image receiving sheets (1) to (3) and a photosensitive sheet were prepared with the structures indicated below.

Image Receiving Sheet (1)

Paper Support

A paper support of thickness 150 μm laminated on both sides with 30 μm of polyethylene. Titanium oxide was added to, and dispersed in, the polyethylene on the image receiving layer side at a rate of 10 wt % with respect to the polyethylene.

Backing Layer Side (a) A light shielding layer containing 4.0 g/m$^2$ of carbon black and 2.0 g/m$^2$ of gelatin.
(b) A white layer containing 8.0 g/m$^2$ of titanium oxide and 1.0 g/m$^2$ of gelatin.
(c) A protective layer containing 0.6 g/m$^2$ of gelatin.

The layers (a) to (c) were established by coating sequentially.

Image Receiving Layer Side (1) A neutralizing layer containing 22 g/m$^2$ of an acrylic acid/butyl acrylate (mol ratio 8:2) copolymer of average molecular weight 50,000.
(2) A neutralization timing layer containing 4.5 g/m$^2$ of a 95:5 mixture by weight of cellulose acetate of which the degree of acetylation was 51.3% (0.513 gram of acetic acid liberated on hydrolysis per gram of sample) and a styrene/maleic anhydride (mol ratio 1:1) copolymer of average molecular weight about 10,000.
(3) A layer containing a total solid fraction of 1.6 g/m$^2$ obtained by blending in the proportions of 6:4 in terms of the solid fractions a polymer latex obtained by the emulsion polymerization in the proportions by weight of 49.7:42.3:4:4 of styrene, butyl acrylate, acrylic acid and N-methylolacrylamide and a polymer latex obtained by the emulsion polymerization in the proportions by weight of 93:3:4 of methyl methacrylate, acrylic acid and N-methylolacrylamide.
(4) An image receiving layer containing 3.0 g/m$^2$ of the polymer indicated below and 3.0 g/m$^2$ of gelatin, established by coating using the coating promotor indicated below.

Coating Promotor

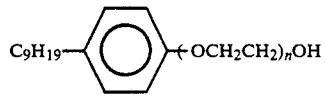

(n = 30)

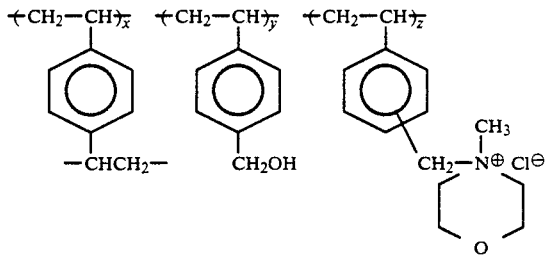

x:y:z = 5:20:75 (mol ratio)

(5) A peeling layer containing 30 mg/m$^2$ of the polymer indicated below.

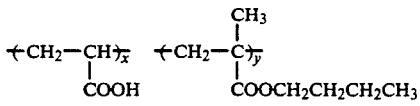

x/y = 85/15 (mol ratio)

Image Receiving Sheets (2) and (3)

These were prepared in the same way except that the polymer in layer (4) of image receiving sheet (1) was changed in the way indicated below.

Image Receiving Sheet (2):3.2 g/m$^2$ of Illustrative Compound (1).

Image Receiving Sheet (3):3.4 g/m$^2$ of Illustrative Compound (2).

Photosensitive Sheet

Photosensitive sheets were prepared by coating the layers indicated below onto transparent poly(ethylene terephthalate) supports.

Backing Layer (a) A light shielding layer containing 4.0 g/m$^2$ of carbon black and 2.0 g/m$^2$ of gelatin.

Emulsion Side Layer (1) A white layer containing 2.8 g/m$^2$ of titanium oxide and 0.4 g/m$^2$ of gelatin.

(2) A layer containing 0.44 g/m$^2$ of the cyan dye releasing redox compound indicated below, 0.09 g/m$^2$ of tricyclohexyl phosphate, 0.008 g/m$^2$ of 2,5-di-tert-pentadecylhydroquinone and 0.8 g/m$^2$ of gelatin.

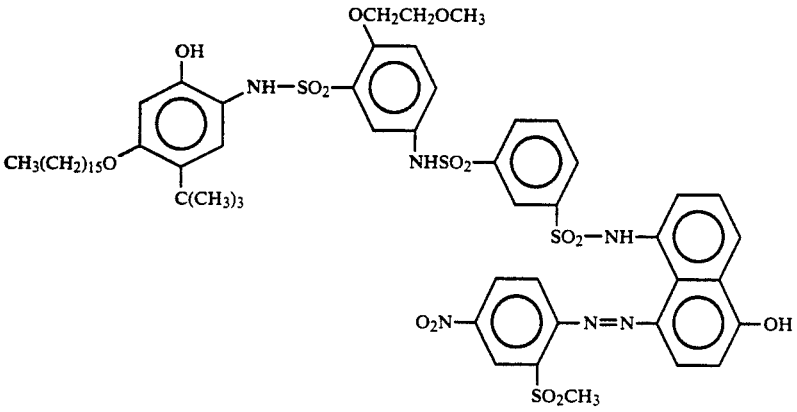

(3) A red sensitive emulsion layer containing a red sensitive internal latent image type direct positive silver bromide emulsion (1.03 g/m$^2$ as silver, 1.28 g/m$^2$ of gelatin), 0.04 mg/m$^2$ of the nucleating agent indicated below and 0.13 g/m$^2$ of 2-sulfo-5-n-pentadecylhydroquinone.sodium salt.

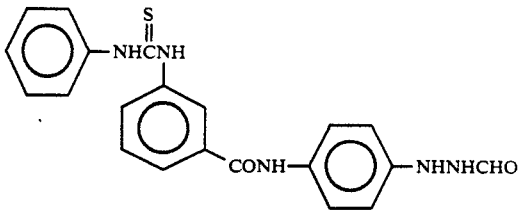

(4) A layer containing 0.43 g/m$^2$ of 2,5-di-tert-pentadecylhydroquinone, 0.1 g/m$^2$ of trihexylphosphate and 0.4 g/m$^2$ of gelatin.

(5) A layer containing 0.21 g/m$^2$ of the magenta dye releasing redox compound of Structural Formula I indicated below, 0.11 g/m$^2$ of the magenta dye releasing redox compound of Structural Formula II indicated below, 0.08 g/m$^2$ of tricyclohexyl phosphate, 0.009 g/m$^2$ of 2,5-di-tert-pentadecylhydroquinone and 0.9 g/m$^2$ of gelatin.

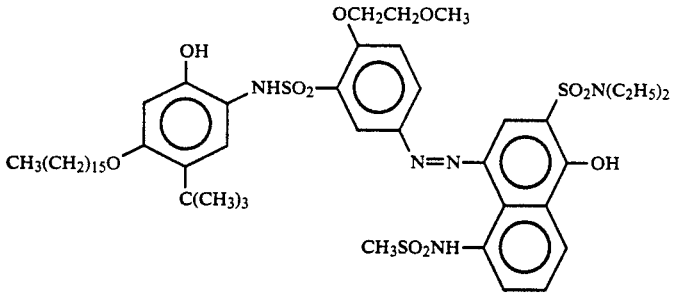

Structural Formula I

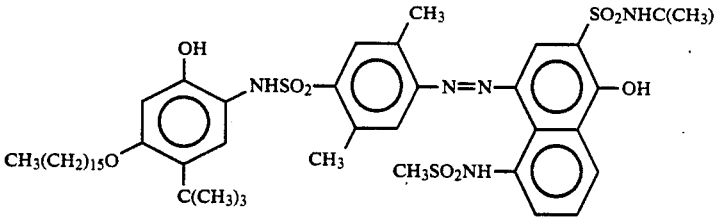

Structural Formula II (6) A green sensitive emulsion layer containing a green sensitive internal latent image type direct positive silver bromide emulsion (0.82 g/m$^2$ as silver, 0.9 g/m$^2$ of gelatin), 0.03 mg/m$^2$ of the same nucleating agent as used in layer (2) and 0.08 g/m$^2$ of 2-sulfo-5-n-pentadecylhydroquinone.sodium salt.

(7) A layer the same as layer (3)

(8) A layer containing 0.53 g/m² of the yellow dye releasing redox compound of which the structural formula is indicated below, 0.13 g/m² of tricyclohexyl phosphate, 0.014 g/m² of 2,5-di-tert-pentadecylhydroquinone and 0.7 g/m² of gelatin.

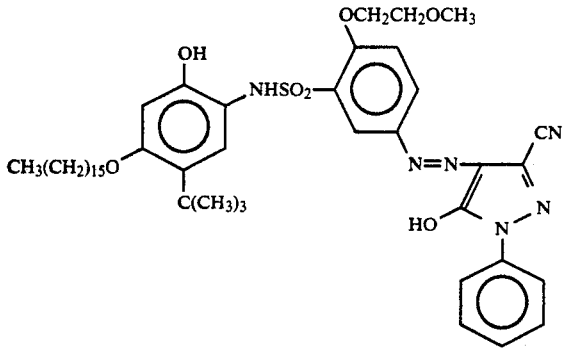

(9) A blue sensitive emulsion layer containing a blue sensitive internal latent image type direct positive silver bromide emulsion (1.09 g/m² as silver, 1.1 g/m² of gelatin), 0.04 g/m² of the same nucleating agent as used in layer (2), and 0.07 g/m² of 2-sulfo-5-n-pentadecylhydroquinone.sodium salt.

(10) A layer containing 1.0 g/m² of gelatin.

Photosensitive sheets were exposed with a color test chart and then laminated with the image receiving sheets (1) to (3) and in each case the processing fluid indicated below was spread between the two sheets. The spreading was accomplished using a pressure roller. The depth of the processing fluid was set at 65 μm.

Processing was carried out at 15° C., the image receiving sheet was peeled away from the photosensitive sheet after processing for 3 minutes, and the samples were examined for the occurrence of pink staining.

| Processing Fluid | |
|---|---|
| 1-p-Tolyl-4-hydroxymethyl-4-methyl-3-pyrazolidone | 8.0 g |
| Methylhydroquinone | 0.1 g |
| 5-Methylbenzotriazole | 5.0 g |
| Sodium sulfite (anhydrous) | 2.0 g |
| Hydroxyethylcellulose | 40 g |
| Potassium hydroxide | 56 g |
| Benzyl alcohol | 2.0 g |
| Water | to make 1 kg |

After peeling apart, the samples were left to stand for 1 hour under conditions of 15° C., 70% RH, after which the reflection density of the white exposed parts was measured using a G filter. The results obtained were as shown in Table 4.

TABLE 4

| Image Receiving Sheet | G Filter Density |
|---|---|
| (1) (Comp. Ex.) | 0.18 |
| (2) (Invention) | 0.17 |
| (3) (Invention) | 0.15 |

The polymer of the present invention also showed the effect of inhibiting the occurrence of pink staining in this system.

While the invention has been described in detail and with reference to specific embodiments thereof, it will be apparent to one skilled in the art that various changes and modifications can be made therein without departing from the spirit and scope thereof.

What is claimed is:

1. A diffusion transfer photographic element comprising at least one layer which contains a water based polymer dispersion obtained by adding at least one ethylenic unsaturated monomer which contains a sulfinic acid group to a polymer dispersion which contains repeating units which have at least one quaternary ammonium salt and carrying out a polymerization, wherein the at least one ethylenic unsaturated monomer which contains a sulfinic acid group is added to the polymer dispersion in an amount of from 0.1 to 70 mol % relative to a total amount of the quaternary ammonium salt present in the polymer dispersion.

2. The diffusion transfer photographic element of claim 1 wherein the polymer dispersion which contains repeating units which have at least one quaternary salt is represented by formula (I):

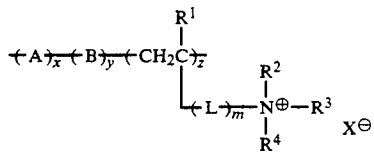

(I)

wherein A represents a monomer unit for which a copolymerizable monomer has been copolymerized in such a way that at least two copolymerizable ethylenic unsaturated groups are contained in the unit and at least one of these groups is contained in a side chain; B represents a monomer unit for which a copolymerizable ethylenic unsaturated monomer has been copolymerized; $R^1$ represents a hydrogen atom, a lower alkyl group or an aralkyl group; L represents a divalent linking group which has from 1 to 20 carbon atoms; $R^2$, $R^3$ and $R^4$ which may be the same or different, each represents an unsubstituted alkyl group or a substituted alkyl group which has from 1 to 20 carbon atoms or an unsubstituted aryl group or a substituted aryl group which has from 6 to 20 carbon atoms, and any two of the groups represented by $R^2$, $R^3$, $R^4$ and L may be joined together to form, together with the nitrogen atom, a ring structure; $X^{\ominus}$ represents an anion; m represents 0 or 1; x represents a mol percentage value of from 0 to 60; y represents a mol percentage value of from 0 to 95; and z represents a mol percentage value of from to 5 to 100.

3. The diffusion transfer photographic element of claim 2 wherein the ethylenic unsaturated monomer which contains sulfinic acid groups is represented by formula (II):

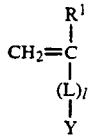
(II)
wherein, $R^1$ and L are the same as in formula (I), l represents 0 or 1 and Y represents a sulfinic acid group or a sulfinic acid group which has formed a salt.
* * * * *
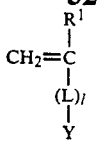
(II)
wherein, $R^1$ and L are the same as in formula (I), l represents 0 or 1 and Y represents a sulfinic acid group or a sulfinic acid group which has formed a salt.
* * * * *